US007845029B2

(12) United States Patent
Kolechstein

(10) Patent No.: US 7,845,029 B2
(45) Date of Patent: Dec. 7, 2010

(54) FLOATABLE SWIMMING POOL COVER

(76) Inventor: Ami Kolechstein, 3985 Norwood Avenue, North Vancouver, British Columbia (CA) V7N 3R4

( * ) Notice: Subject to any disclaimer, the term of this patent is extended or adjusted under 35 U.S.C. 154(b) by 1398 days.

(21) Appl. No.: 11/296,638

(22) Filed: Dec. 8, 2005

(65) Prior Publication Data

US 2007/0130680 A1 Jun. 14, 2007

(51) Int. Cl.
*E04H 4/00* (2006.01)

(52) U.S. Cl. ..... 4/498

(58) Field of Classification Search ..... 4/498, 4/499, 501, 503, 504; 220/219
See application file for complete search history.

(56) References Cited

U.S. PATENT DOCUMENTS

| | | | | |
|---|---|---|---|---|
| 2,970,320 | A | 2/1961 | Karp | |
| 3,184,763 | A | 5/1965 | Kennedy | |
| 3,313,443 | A * | 4/1967 | Dial et al. | 4/498 |
| 3,780,385 | A | 12/1973 | Dunn | |
| 3,813,704 | A | 6/1974 | Troiano | |
| 3,871,033 | A | 3/1975 | Bartlett | |
| 3,889,303 | A | 6/1975 | Kinzel | |
| 3,927,427 | A | 12/1975 | Aine | |
| 4,103,368 | A * | 8/1978 | Lockshaw | 4/499 |
| 4,197,595 | A | 4/1980 | Dearing | |
| 4,601,072 | A | 7/1986 | Aine | |
| 4,626,005 | A | 12/1986 | Stifter | |
| 4,716,603 | A | 1/1988 | Semetz | |
| 4,953,239 | A | 9/1990 | Gadsby | |
| 5,144,704 | A | 9/1992 | Genzel et al. | |
| 6,286,157 | B1 | 9/2001 | Baumann | |

FOREIGN PATENT DOCUMENTS

| | | |
|---|---|---|
| CA | 1184825 | 4/1985 |

OTHER PUBLICATIONS

International Search Report dated Jan. 24, 2008 in correction with corresponding PCT application No. PCT/CA2007/000817.

* cited by examiner

*Primary Examiner*—Tuan N Nguyen
(74) *Attorney, Agent, or Firm*—Oyen Wiggs Green & Mutala LLP

(57) ABSTRACT

In one of its aspects, the invention provides a cover for a body of water, the cover comprising one or more tiles. Each tile comprises a generally flattened tile body floatable atop the body of water to cover a surface area thereof. The tile body defines an enclosure wherein at least a portion of the tile body that defines the enclosure is deformable. Each tile also comprises a ballast having a density greater than water and a port for conveying a fluid having a density less than water into and out of the enclosure. Upon conveying the fluid into the enclosure via the port, the portion of the tile body deformably expands to increase a volume of the enclosure and increase a buoyancy of the tile and, upon conveying the fluid out of the enclosure via the port, the portion of the tile body deformably contracts to decrease the volume of the enclosure and decrease the buoyancy of the tile.

31 Claims, 19 Drawing Sheets

FLOATABLE SWIMMING POOL COVER

FIELD OF THE INVENTION

This invention relates to swimming pool covers. Particular embodiments of the invention provide swimming pool covers formed from one or more floatable tiles.

BACKGROUND OF THE INVENTION

Pool covers may be used for a variety of reasons, including (without limitation) providing thermal isolation for the water in a pool, reducing evaporation of the pool water and reducing the accumulation of debris in the pool water.

Floatable insulating pool covers that are adapted to sink to the bottom of the pool when not in use provide convenience to a pool owner. These types of floatable covers avoid the unwieldy work of removing pool covers from the water surface and reinstalling pool covers in place atop the water surface. Floatable insulating pool covers are known in the art. Such pool covers are disclosed in U.S. Pat. No. 4,626,005 (Stifter); U.S. Pat. No. 2,970,320 (Karp); U.S. Pat. No. 3,184,763 (Kennedy); and U.S. Pat. No. 4,716,603 (Sernetz). These systems have a number of deficiencies which, it is presumed, have prevented them from gaining widespread acceptance among consumers.

There is a general desire to provide pool covers which overcome, or at least ameliorate, some of the deficiencies with these prior art systems.

A pool can be dangerous for children and others who are unable to swim. Pool covers that are insufficiently buoyant (in any localized region of the pool) to support the weight of a person who may fall onto the cover can exacerbate this danger. Even where a person who falls on the cover is capable of swimming, pool covers can cause danger by wrapping around the person and preventing the person from moving his or her limbs.

There is a general desire to provide pool covers which minimize the danger of drowning to a person who falls onto the pool cover.

Many regional and/or municipal authorities provide regulations in respect of pools and their covers. It is desirable to provide pool covers that comply with such regulations.

SUMMARY OF THE INVENTION

One aspect of the invention provides a cover for a body of water, the cover comprising one or more tiles. Each tile comprises a generally flattened tile body floatable atop the body of water to cover a surface area thereof. The tile body defines an enclosure wherein at least a portion of the tile body that defines the enclosure is deformable. Each tile also comprises a ballast having a density greater than water and a port for conveying a fluid having a density less than water into and out of the enclosure. Upon conveying the fluid into the enclosure via the port, the portion of the tile body deformably expands to increase a volume of the enclosure and increase a buoyancy of the tile and, upon conveying the fluid out of the enclosure via the port, the portion of the tile body deformably contracts to decrease the volume of the enclosure and decrease the buoyancy of the tile.

The cover may comprise a deformation sensing system for sensing deformation of the tile body. The deformation sensing system may be operatively coupled to a fluid flow limiter located between the port and the enclosure for discontinuing conveyance of the fluid into the enclosure when the deformation of the portion of the tile body is greater than an upper deformation threshold. The deformation sensing system may be operatively coupled to a fluid flow limiter located between the port and the enclosure for discontinuing conveyance of the fluid out of the enclosure when the deformation of the portion of the tile body is less than a lower deformation threshold.

The deformation sensing system may comprise one or more arms which engage the tile body such that deformation of the portion of the tile body causes movement of the one or more arms. The one or more arms may be mechanically coupled to the fluid flow limiters, such that movement of the one or more arms actuates the fluid flow limiters.

The deformation sensing system may comprise a pair of arms that pivot relative to one another about one or more pivot joints. The pair of arms may engage the tile body, such that deformation of the portion of the tile body changes a relative pivotal orientation of the arms.

The deformation sensing system may comprise a pivotable arm. A portion of the pivotal arm may engage the tile body, such that deformable expansion of the tile body causes the arm to pivot in a first angular direction and deformable contraction of the tile body causes the arm to pivot in a second angular direction.

Each tile may comprises a buoyancy control valve assembly in fluid communication between the port and the enclosure. The buoyancy control valve assembly may comprise: first and second fluid paths between the port and the enclosure; a first one-way valve configured to allow fluid flow from the port to the enclosure via the first fluid path and to prevent fluid flow from the enclosure to the port via the first fluid path; and a second one-way valve configured to allow fluid flow from the enclosure to the port via the second fluid path and to prevent fluid flow from the port to the enclosure via the second fluid path.

The buoyancy control valve assembly may comprise at least one selectively-actuatable valve mechanism configurable to a first state wherein fluid flow between the port and the enclosure via the first fluid path is prevented and to a second state wherein fluid flow between the enclosure and the port via the second path is prevented.

The buoyancy control valve assembly may comprise: a first selectively-actuatable valve configurable to allow fluid flow between the port and the enclosure via the first fluid path when the first selectively-actuatable valve is in a first flow state and to prevent fluid flow between the port and the enclosure via the first fluid path when the first selectively-actuatable valve is in a flow-prevention state; and a second selectively-actuatable valve configurable to allow fluid flow between the enclosure and the port via the second fluid path when the second selectively-actuatable valve is in a second flow state and to prevent fluid flow between the enclosure and the port via the second fluid path when the second selectively-actuatable valve is in a second flow-prevention state.

The cover may comprise a plurality of tiles and at least one coupler. The coupled may comprise four deformable branches that extend outwardly from a central region in four angularly spaced apart directions, each branch comprising one or more fastener component. The coupler may be coupleable to one of the plurality of tiles by extending a corner of the tile into an angular region between first and second adjacent branches of the coupler, fastening the first branch to a first side of the tile using at least one of the fastener components of the first branch and fastening the second branch to a second side of the tile on using at least one of the fastener components of the second branch, the first and second sides of the tile on opposing sides of the corner.

The upper and lower deformation thresholds of the tile body may additionally or alternatively be upper and lower volume thresholds of the enclosure.

Another aspect of the invention provides a method for controlling a buoyancy of a pool cover having one or more tiles. The method involves: providing a tile having a tile body which defines an enclosure wherein at least a portion of the tile body that defines the enclosure is deformable; conveying a fluid having a density less than water into the enclosure to deformably expand the portion of the tile body, thereby increasing a volume of the enclosure and increasing a buoyancy of the tile; sensing deformation of the portion of the tile body; and discontinuing conveying the fluid into the enclosure upon sensing that the deformation of the portion of the tile body is greater than an upper deformation threshold.

The method may also involve conveying the fluid out of the enclosure to deformably contract the portion of the tile body, thereby decreasing the volume of the enclosure and decreasing a buoyancy of the tile; and discontinuing conveying the fluid out of the enclosure upon sensing that the deformation of the portion of the tile body is less than a lower volume threshold.

Another aspect of the invention provides a pool cover comprising: at least one hollow, flattened tile body having a deformable cover; and a valve for controlling admission of a fluid into the hollow, flattened tile body, the valve actuated by motion of the deformable cover.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

In drawings which illustrate non-limiting embodiments of the invention.

DETAILED DESCRIPTION OF THE INVENTION

Figure 1:
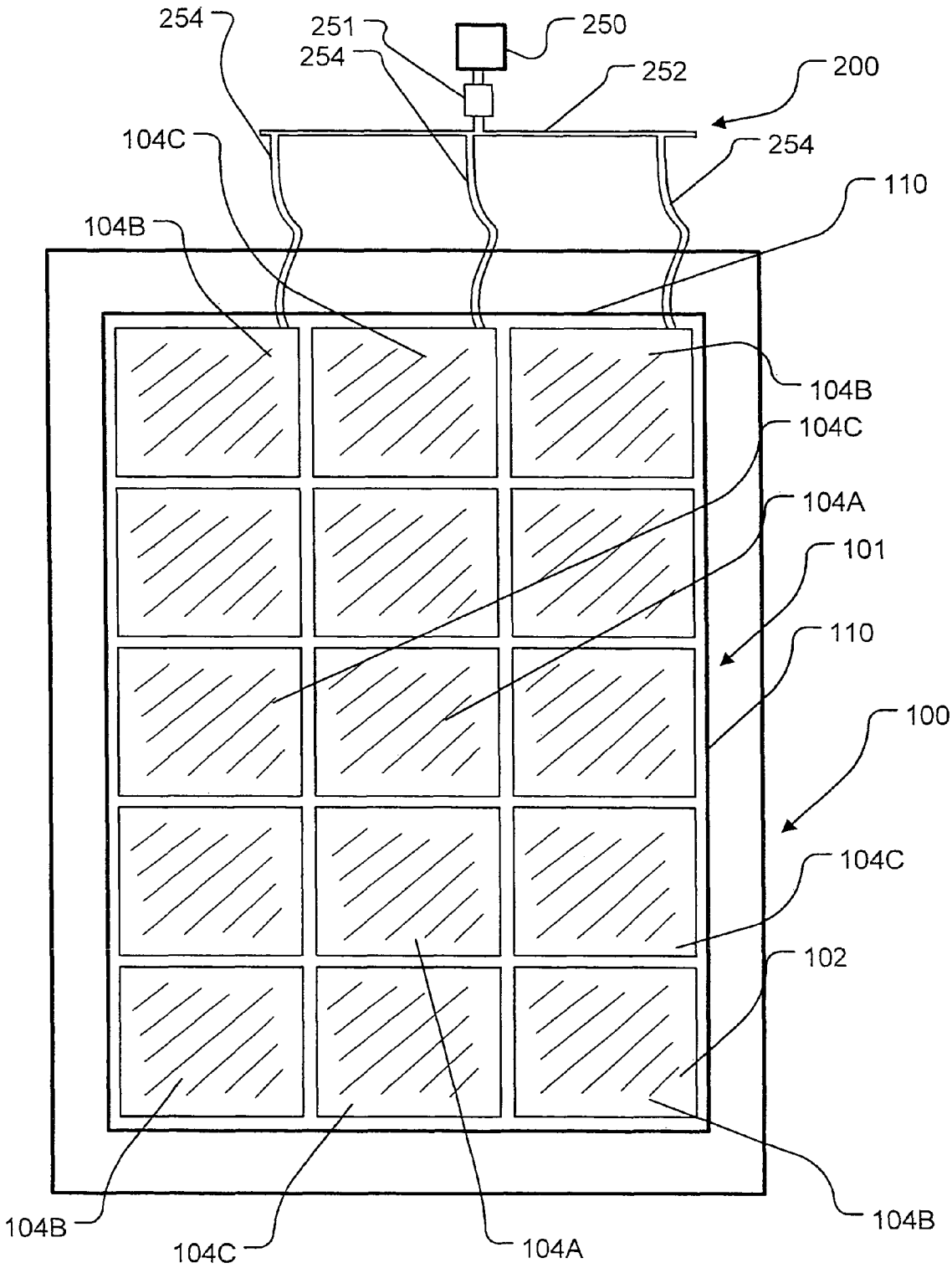
FIG. 1 is a schematic top plan view of a swimming pool incorporating a pool cover according to a particular embodiment of the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of the invention provide floatable pool covers which comprise one or more generally flattened tiles. Each tile has a generally flattened tile body which is floatable atop the pool water to provide a surface which covers an area of the pool. The tile body defines a deformable enclosure. Air may be introduced into the enclosure to expand the volume of the tile body, thereby decreasing the specific gravity of the tile and causing the tile to float on the water surface. Air may be withdrawn from the enclosure causing the volume of the tile body to contract, increasing the specific gravity of the tile and causing the tile to sink to the pool bottom. When the tile is at the pool bottom, it provides a substantially flat and robust surface which facilitates cleaning and maintenance of the pool cover and which provides safety for swimmers in the pool.

The tile may incorporate one or more deformation sensing systems. The deformation sensing systems are sensitive to deformation of the tile body and/or to changes in the enclosure volume that accompanies such deformation. The deformation sensing system(s) may be operatively coupled to one or more fluid flow limiters to control the flow of air into and/or out of the enclosure and/or the tile. The deformation sensing system(s) may be mechanically coupled the fluid flow limiter (s) to form a mechanical flow controllers. A mechanical flow controller may limit the flow of air into its associated enclosure when deformation of the tile body reaches an upper deformation threshold or when the volume of the enclosure reaches an upper volume threshold. The mechanical flow controller may also limit the withdrawal of air from its associated enclosure when deformation of the tile body reaches a lower deformation threshold or when the volume of the enclosure reaches a lower volume threshold.

The deformation sensing system may be mechanical in nature. In one particular embodiment, the deformation sensing system comprises one or more arms, each of which has a first end that bears against (or otherwise engages) the tile body to detect deformation thereof. The first ends of the arms may engage covers of the enclosure to detect deformation of the enclosure covers. The arms may be actuated by the enclosure covers. The deformation sensing system may comprise a pivotal assembly where second ends of the arms are capable of pivoting about one or more pivot joints. The mechanical flow controller may limit the flow of air into and/or out of the enclosure by actuating one or more selectively actuatable valves. The selectively actuatable valves may be actuated by the arms of the deformation sensing system. The one or more mechanical flow controller preferably comprise a single mechanism that is operable to sense the deformation of the tile body and/or volume of the enclosure and/or tile and to limit the flow of air into and out of the enclosure in response to changes in the deformation/volume.

A pool cover may comprise a plurality of tiles which may be coupled to one another using flexible couplers. Each coupler may be cross-shaped to provide four branches and four interior corners (i.e. one interior corner between each pair of branches). A tile may be received in each interior corner of a coupler and the pair of branches that form the interior corner may be coupled to the tile on different sides thereof. A coupler may accommodate up to four tiles (i.e. one in each interior corner). The couplers may also convey air between tiles.

FIG. 1 is a plan view of a pool 100 covered by a pool cover 101 according to a particular embodiment of the invention. Pool cover 101 comprises a network 102 of tiles 104. In the illustrated embodiment, network 102 of tiles 104 comprises a plurality of tiles 104. However, cover 101 may generally comprise as few as one tile 104. Tiles 104 have a generally flattened shape and are floatable atop the pool water to provide a surface which covers an area of the pool. Because of the generally flattened shape of tiles 104, the longitudinal and lateral dimensions of tiles 104 may be significantly greater than their depth. In some embodiments, the ratio of each of the longitudinal and lateral dimensions of tiles 104 to the depth of tiles 104 is greater than 5:1. In some embodiments, the lateral and longitudinal dimensions of each tile 104 provides a pool covering surface area greater than or equal to 0.3 $m^2$. In other embodiments, tiles provide a pool covering surface area greater than or equal to 0.5 $m^2$. In still other embodiments, tiles provide a pool covering surface area greater than or equal to 1.0 $m^2$.

In the illustrated embodiment, network 102 of tiles 104 comprises inner tiles 104A, which are generally rectangular in shape. Tile network 102 may also comprise corner tiles 104B and edge tiles 104C. In the illustrated embodiment, inner tiles 104A, corner tiles 104B and edge tiles 104C are all generally rectangular in shape. Preferably, the distance between corner tiles 104B, edge tiles 104C and the edge 110 of pool 100 is sufficiently small that a person (particularly a child) is prevented from falling between edge 110 and cover 101. In some embodiments, cover 101 may incorporate a skirt (not shown) formed from deformable plastic, rubber or other suitable material which extends between corner tiles 104B, edge tiles 104C and the edge 110 of pool 100. In some embodiments, corner tiles 104B and edge tiles 104C may be shaped to conform with the edges of a pool that is not rectilinear.

Figure 2:
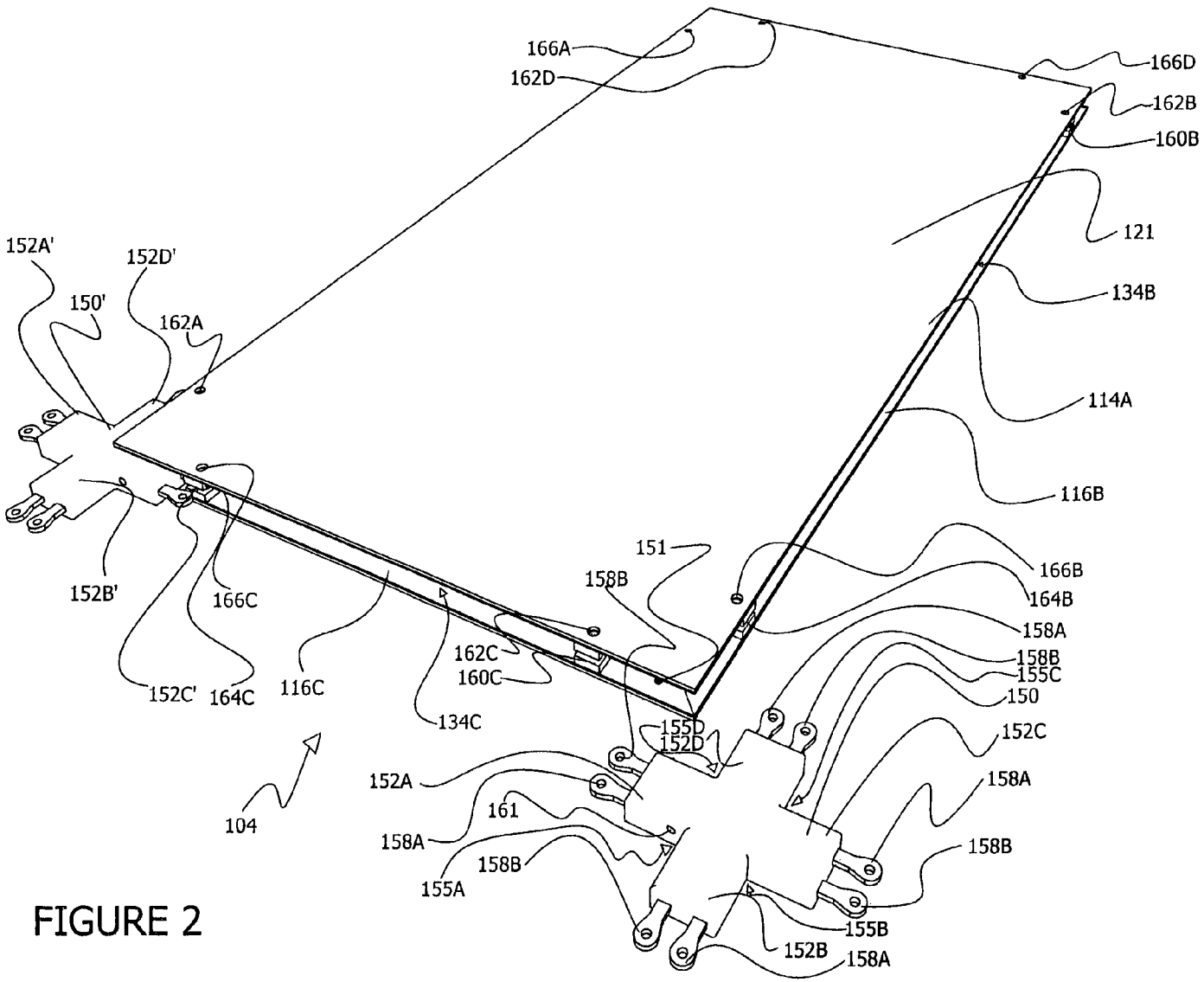
FIG. 2 is a partially exploded isometric view of a tile of the FIG. 1 pool cover together with tile couplers on two of its corners.

FIG. 2 depicts a tile 104 suitable for use with cover 101. Tile 104 includes a tile body 121 which comprises a generally planar upper cover 114A and, on its opposing side, a generally planar lower cover 114B. In some embodiments, upper and lower covers 114 are fabricated from nylon, polypropylene, polyethylene or some other suitable plastic. Upper and lower covers 114 are at least moderately deformable.

Figure 3:
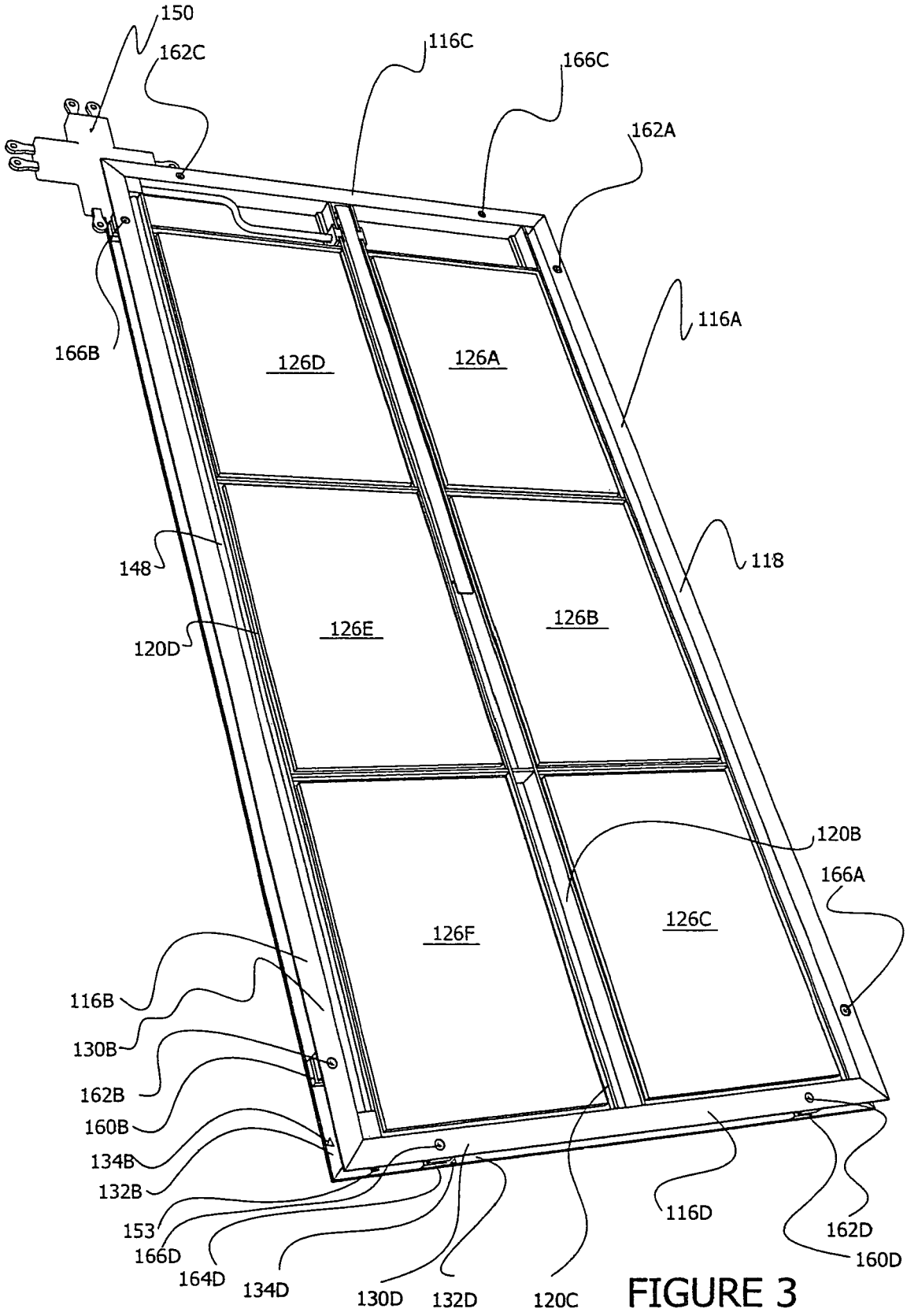
FIG. 3 is an isometric view of the FIG. 2 tile with its covers removed.
Figure 4:
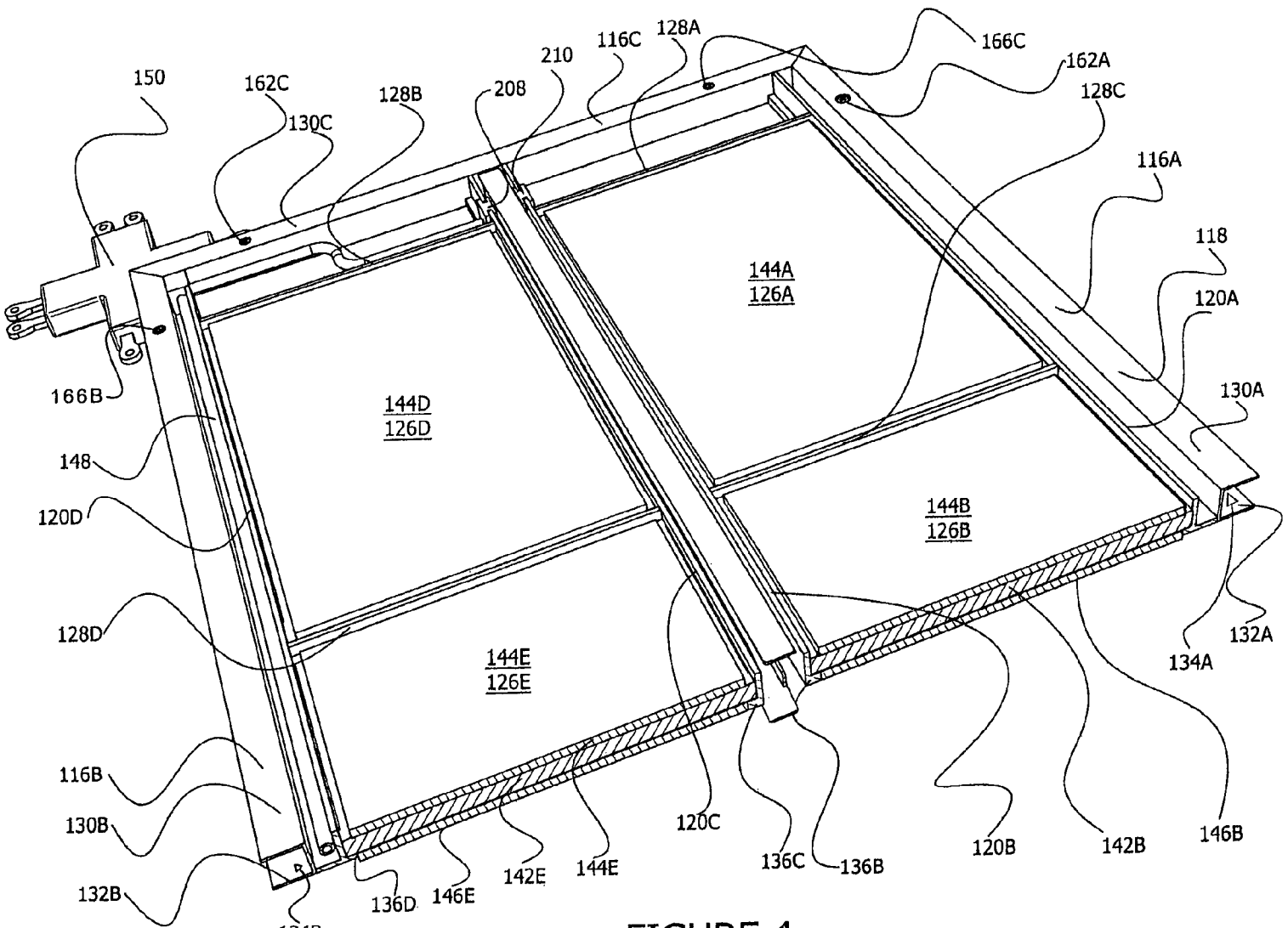
FIG. 4 is an isometric sectional view of the FIG. 2 tile which shows more detail of its ballast assemblies.
Figure 5:
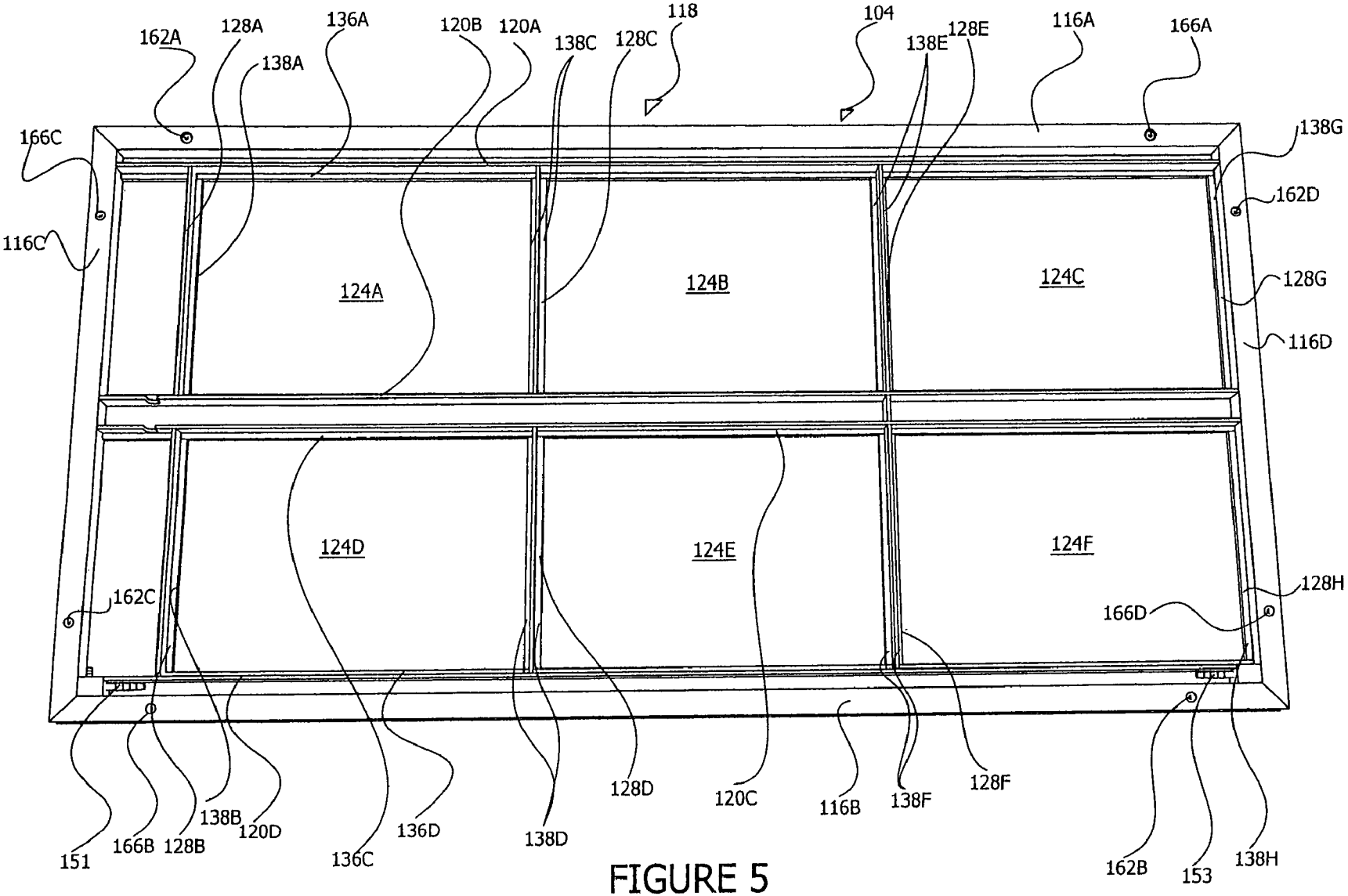
FIG. 5 is an isometric view of the frame of the FIG. 2 tile.

FIGS. 3, 4 and 5 show tile 104 (or portions of tile 104) with some of its components (including covers 114) removed to show more detail of the interior structure of tile 104. Tile 104 comprises a frame 118 which, in the illustrated embodiment, includes a number of external frame members 116A-116D (collectively, 116) and a number of internal frame members 120A-120D (collectively, 120), 128A-128H (collectively, 128). External frame members 116 and internal frame members 120, 128 may be fabricated from any suitable material, such as nylon or plastic. Preferably, however, external frame members 116 and internal frame members 120, 128 are relatively rigid in comparison to upper and lower covers 114.

External frame members 116 (together with upper and lower covers 114) define tile body 121. As shown best in FIG. 5, external frame members 116 may comprise a pair of longitudinal frame members 116A, 116B and a pair of transverse frame members 116C, 116D arranged in a generally rectangular form. In the illustrated embodiment, internal frame members 120, 128 are arranged to define a plurality of regions 124 which may house ballast assemblies 126 as described in more detail below. In the FIG. 5 embodiment, frame 118 comprises four longitudinal internal frame members 120A-120D and eight transverse frame members 128A-128H, which together define six ballast regions 124A-124F (collectively, 124). Portions of ballast regions 124 may additionally or alternatively be defined by external frame members 116. In some embodiments, frame 118 including external frame members 116 and internal frame members 120 are fabricated as a single monolithic unit. In other embodiments, external frame members and internal frame members 120 are fabricated from separate components which are joined together by welding or using other suitable fastening technique.

As shown best in FIGS. 3 and 4, external frame members 116A-116D may be U-shaped in cross-section to provide upper frame flanges 130A-130D (collectively, 130), lower frame flanges 132A-132D (collectively 132) and outwardly-opening channels 134A-134D (collectively 134) therebetween. As shown best in FIGS. 4 and 5, portions of internal frame members 120A-120D may be L-shaped in cross-section to provide transversely-projecting ledges 136A-136D (collectively, 136) in ballast regions 124. Similarly, portions of internal frame members 128A-128H may be L-shaped or T-shaped in cross-section to provide longitudinally-projecting ledges 138A-138H (collectively, 138) in ballast regions 124. In other embodiments, only portions of internal frame members 120, 128 are L-shaped or T-shaped in cross-section to provide ledges 136, 138 which are formed from smaller, spaced apart ledge segments that do not extend fully across the dimensions of ballast regions 124.

Each external frame member 116A-116D of tile 104 may also incorporate a a coupling bracket 160A-160D (collectively, 160) at or near a first end and a coupling bracket 164A-164D (collectively, 164) at or near a second end (see FIG. 2). Coupling brackets 160, 164 are preferably integrally formed with their respective frame members 116. Coupling brackets 160, 164 may alternatively be separate components which are joined to their respective frame members 116 by welding or using some other suitable fastening technique. In the illustrated embodiment, each coupling bracket 160 comprises an aperture 162 and each coupling bracket 164 comprises an aperture 166. Apertures 164, 166 preferably extend through their corresponding coupling brackets 160, 164 and through their corresponding frame members 116. Apertures 164, 166 may be shaped to allow for counter-sinking of fastener components. Apertures 164, 166 may be threaded.

Figure 6:
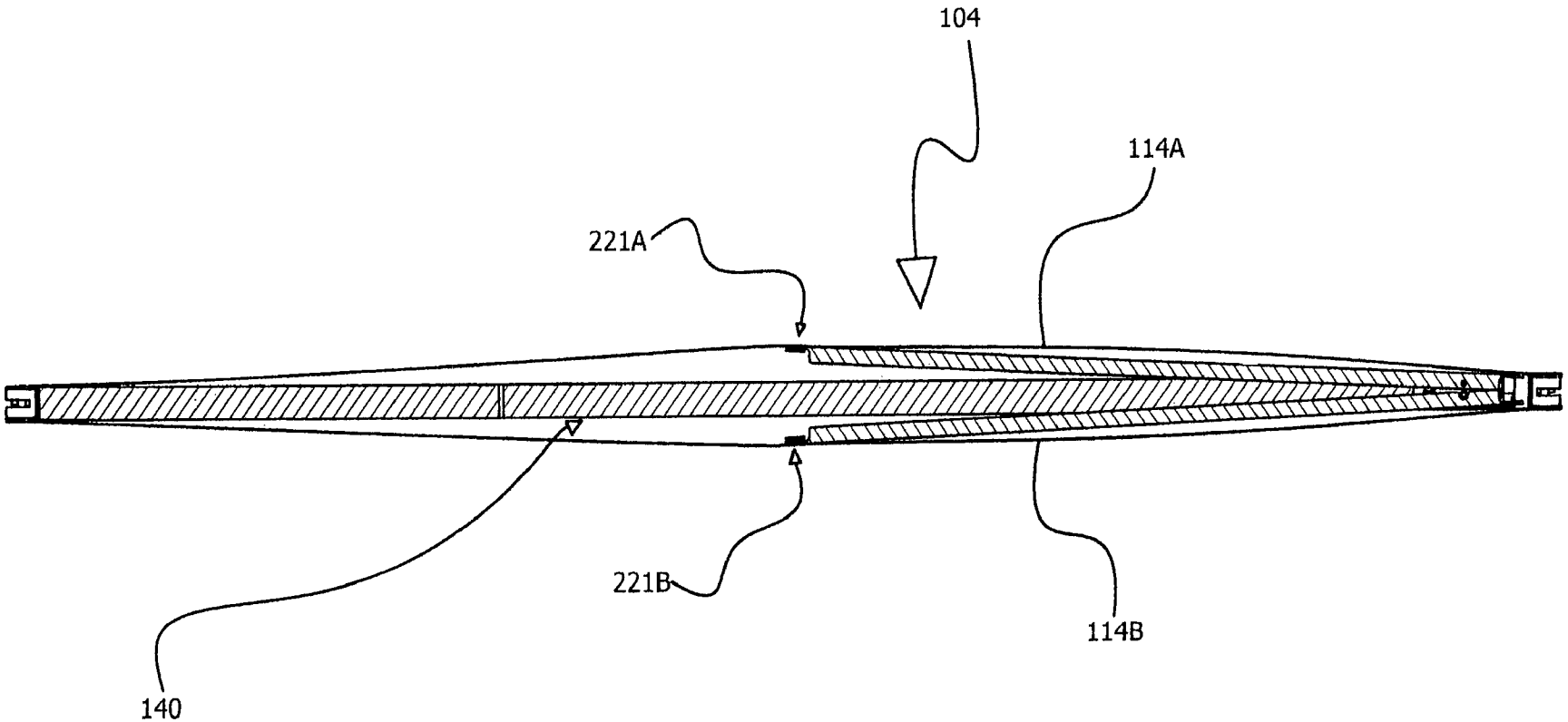
FIG. 6 is a cross-sectional view of the FIG. 2 tile in an expanded state.

As shown in FIG. 6, tile 104 comprises a substantially airtight enclosure 140 formed between upper cover 114A and lower cover 114B. In some embodiments, upper cover 114A is sealed to upper frame flanges 130 of external frame members 116 and lower cover 114B is sealed to lower frame flanges 132 of external frame members 116 to provide airtight enclosure 140 therebetween. The seal between external frame 116 and covers 114 may be formed by plastic welding, by using a suitable sealing compound or by any other suitable technique. Preferably, covers 114 are not sealed to internal frame members 120, 128. Enclosure 140 is located within tile body 121 and may have a generally flattened shape similar to that of tile body 121. The longitudinal and lateral dimensions of enclosure 140 may be significantly greater than its depth. In some embodiments, the ratio of each of the longitudinal and lateral dimensions of enclosure 140 to the depth of enclosure 140 is greater than 4:1. As discussed in more detail below, air may be introduced to enclosure 140 to increase the volume of tile body 121 and to cause tile 104 to float and air may be withdrawn from enclosure 140 to decrease the volume of tile body 121 and to cause tile 104 to sink.

In the illustrated embodiment, tile 104 comprises a plurality of ballast assemblies 126A-126F (collectively, 126). Ballast assemblies 126 are preferably located within enclosure 140. FIGS. 3 and 4 show more detail of ballast assemblies 126. In the illustrated embodiment, each ballast assembly 126A-126F of tile 104 comprises a corresponding ballast 142A-142F (collectively, 142), which is at least partially covered on its upper surface by an upper ballast cover 144A-144F (collectively, 144) and on its lower surface by a lower ballast cover 146A-146F (collectively, 146). Upper and lower ballast covers 144, 146 may be fabricated from a suitable foam, such as polystyrene or the like. Ballast covers 144, 146 may provide positive buoyancy relative to pool water and may insulate the pool water from heat loss. Ballast covers 144, 146 may also be relatively soft to help prevent injury to a person who may fall on tile 104. In addition, ballast covers 144, 146 may act as spacers which support upper and lower covers 114 when air is withdrawn from tile 104. Ballast 142 may comprise any suitably dense material that is negatively buoyant in pool water. In particular embodiments, ballast 142 comprises concrete or ceramic, which may be easily and inexpensively fabricated to have desirable dimensions.

In the illustrated embodiment, ballast assemblies 126 are located in corresponding ballast regions 124 of frame 118 (FIG. 3). When located in ballast regions 124, ballast assemblies 126 may rest on ledges 136, 138 of internal frame members 120, 128. Ballast 142 of each ballast assembly 126 may project longitudinally and transversely from upper and lower ballast covers 144, 146 to be received on corresponding ledges 136, 138 (see FIG. 4). Ballast assemblies 126 may additionally or alternatively be secured to internal frame members 120, 128 using suitable fasteners (e.g. threaded fasteners, deformable clips, fitted joints or the like) or using other techniques (e.g. glue or the like).

Tile 104 also comprises an air conduit 148 (FIGS. 3 and 4). In the illustrated embodiment, air conduit 148 extends longitudinally along one side of tile 104 between external frame member 116B and internal frame member 120D. As shown in FIG. 5, tile 104 may comprise nipple connectors 151, 153 at each of its longitudinal ends. Air conduit 148 may be operatively connected to first ends of nipple connectors 151, 153 to provide fluid communication therebetween. As shown best in FIG. 3, nipple connectors 151, 153 may comprise opposing ends which project through external frame elements 116C, 116D and into channels 134C, 134D. In channels 134C, 134D, the opposing ends of nipple connectors 151, 153 may be protected by upper and lower frame flanges 130C, 130D, 132C, 132D. Those skilled in the art will appreciate that nipple connectors 151, 153 represent only one type of air conduit connector and that other types of valves or conduit connectors could be used in the place of nipple connectors 151, 153.

Figure 7:
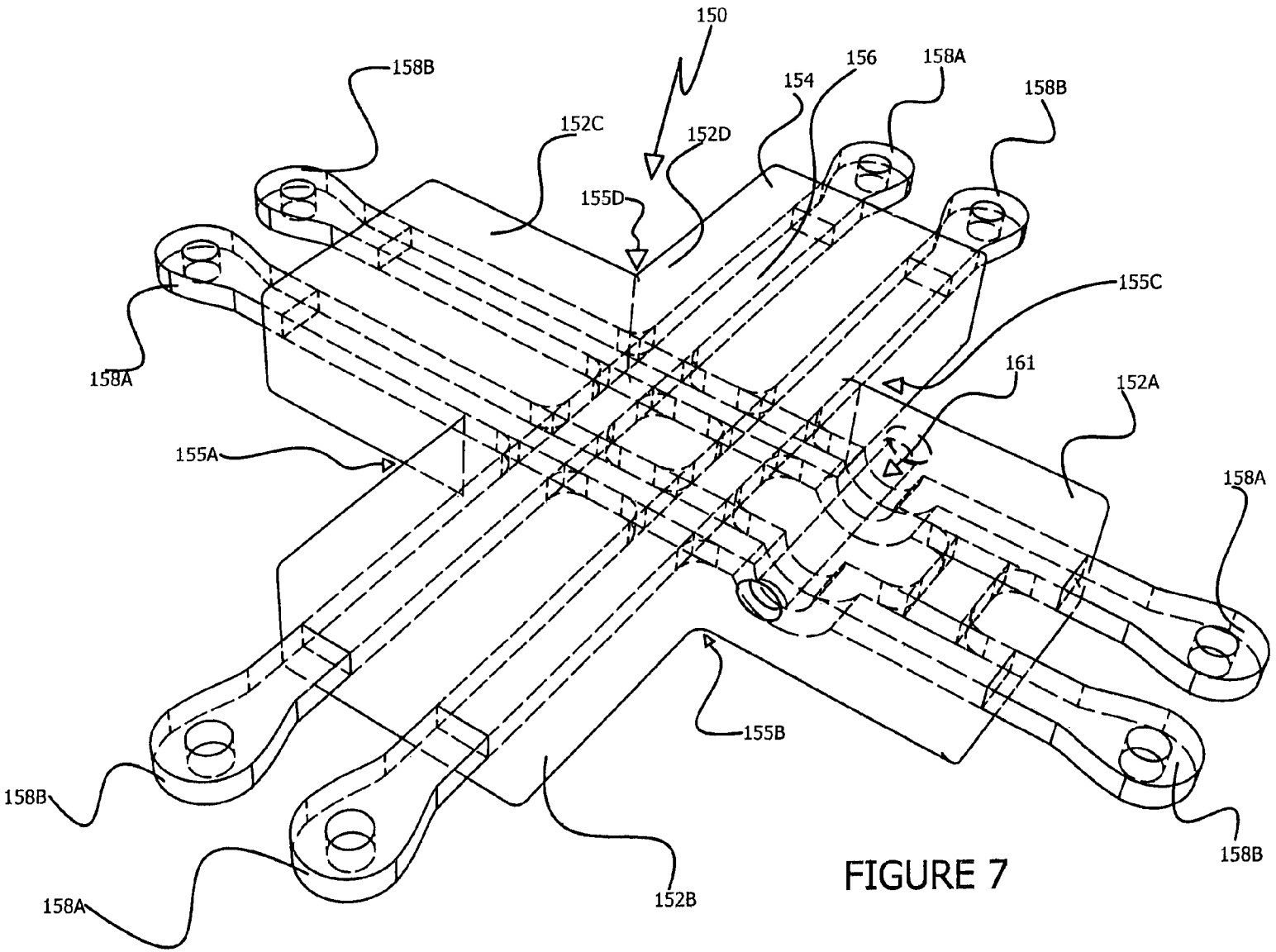
FIG. 7 is an isometric view of a tile coupler suitable for use in the FIG. 1 pool cover.

Tiles 104 in pool cover 101 (FIG. 1) may be moveably coupled to one another using flexible couplers 150. A coupler 150 is depicted in greater detail in FIG. 7. In the illustrated embodiment, coupler 150 is cross-shaped to provide four branches 152A-152D (collectively, 152) and four interior corners 155A-155D (collectively, 155). In the illustrated embodiment, coupler 150 comprises an outer body 154 and an inner frame 156. Outer body 154, which may be cross-shaped, is preferably fabricated from an elastomeric material, such as a suitable rubber, foam, soft plastic or the like. In the illustrated embodiment, inner frame 156 is also cross-shaped to facilitate coupling to four tiles 104 as described in more detail below. To provide coupler 150 with structural support, inner frame 156 may be fabricated from materials that are more rigid than those used to fabricate outer body 154. However, inner frame 156 is preferably fabricated from a material that is at least moderately resiliently deformable, such as nylon, a suitably strong plastic or the like.

Outer body 154 may extend outwardly into each of branches 152 to cover a portion of inner frame 156. This design promotes safety, as outer body 154 is preferably fabricated from a material that is relatively soft compared to inner frame 156. In the illustrated embodiment, inner frame 156 comprises a pair of coupling brackets 158A, 158B which extend outwardly from the ends of each branch 152. Coupling brackets 158A, 158B may be threaded. As explained in more detail below, a tile 104 may be received in each interior corner 155 (i.e. between a corresponding pair of branches 152) and may be fastened to the pair branches 152 using a coupling bracket 158A from the first branch 152 and a coupling bracket 158B from the second branch 152. In this manner, flexible coupler 150 may be used to couple as many as four tiles 104 (i.e. one tile 104 for each interior corner 155). In the illustrated embodiment, coupling brackets 158 comprise female fastener components, but in general, coupling brackets 158 may comprise any type of fastener component(s) which are capable (alone or in combination with other fastener component(s)) of attaching coupler 150 to tiles 104 as described below.

Coupler 150 also comprises a conduit 161 that extends through one of its branches 152A. As described in more detail below, nipple connectors 151, 153 of adjacent tiles 104 may be connected to opposing ends of conduit 161 to provide fluid flow between the air conduits 148 of adjacent tiles 104 via conduit 161.

The operation of coupler 150 is best understood with reference to FIG. 2. Coupler 150 may be used to couple as many as four tiles 104, with each of the four tiles 104 received in a corresponding interior corner 155 and coupled to a corresponding pair of branches 152. Each tile 104 is coupled to one of the coupling brackets 158A on a first branch 152 and to the other one of the coupling brackets 158B on the second branch 152. FIG. 2 shows two couplers 150 and 150'. The tile 104 illustrated in FIG. 2 has one of its corners received in interior corner 155D of coupler 150. Branch 152D of coupler 150 projects into channel 134B and branch 152A of coupler 150 projects into channel 134C. To fasten coupler 150 to tile 104, a male fastener element (not shown) projects through aperture 162C, coupling bracket 160C and channel 134C and through female coupling bracket 158B of branch 152A and a similar male fastener component (not shown) projects through aperture 166B, coupling bracket 164B and channel 134B and through female coupling bracket 158A of branch 152D. In addition, nipple connector 151 of tile 104 may project into a first end of conduit 161 of coupler 150.

In a similar manner, a longitudinally-adjacent tile 104 (not shown) may be received in interior corner 155A and may be coupled to branches 152A, 152B of coupler 150. The nipple connector 153 of the longitudinally-adjacent tile 104 may project into the opposing end of conduit 161 and coupling brackets 164D, 160B of the longitudinally-adjacent tile 104 may be respectively connected to coupling bracket 158A of branch 152A and coupling bracket 158B of branch 152B. A transversely-adjacent tile 104 (not shown) may be received in interior corner 155C and may be coupled to branches 152C, 152D of coupler 150. Coupling brackets 164C, 160A of the transversely-adjacent tile 104 may be respectively connected to coupling bracket 158A of branch 152C and coupling bracket 158B of branch 152D. Finally, a diagonally-adjacent tile 104 (not shown) may be received in interior corner 155B and may be coupled to branches 152B, 152C of coupler 150. Coupling brackets 164A, 160D of the diagonally-adjacent tile may be respectively connected to coupling bracket 158A of branch 152B and coupling bracket 158B of branch 152C. Those skilled in the art will appreciate that coupler 150' of FIG. 2 may be used in a similar manner to couple tile 104 to the longitudinally-adjacent tile 104 and two other adjacent tiles.

As discussed above, couplers 150 are preferably at least moderately deformable and resilient, such that adjacent tiles 104 may move independently from one another by deforming couplers 150. This resilient deformability is useful to help pool covers 101 incorporating pluralities of tiles 104 to conform with the bottom 170 of pool 100, which has different depths as explained in more detail below. Preferably, tiles are torsionally deformable about both their longitudinal and transverse axes and are also capable of bending.

Figure 8:
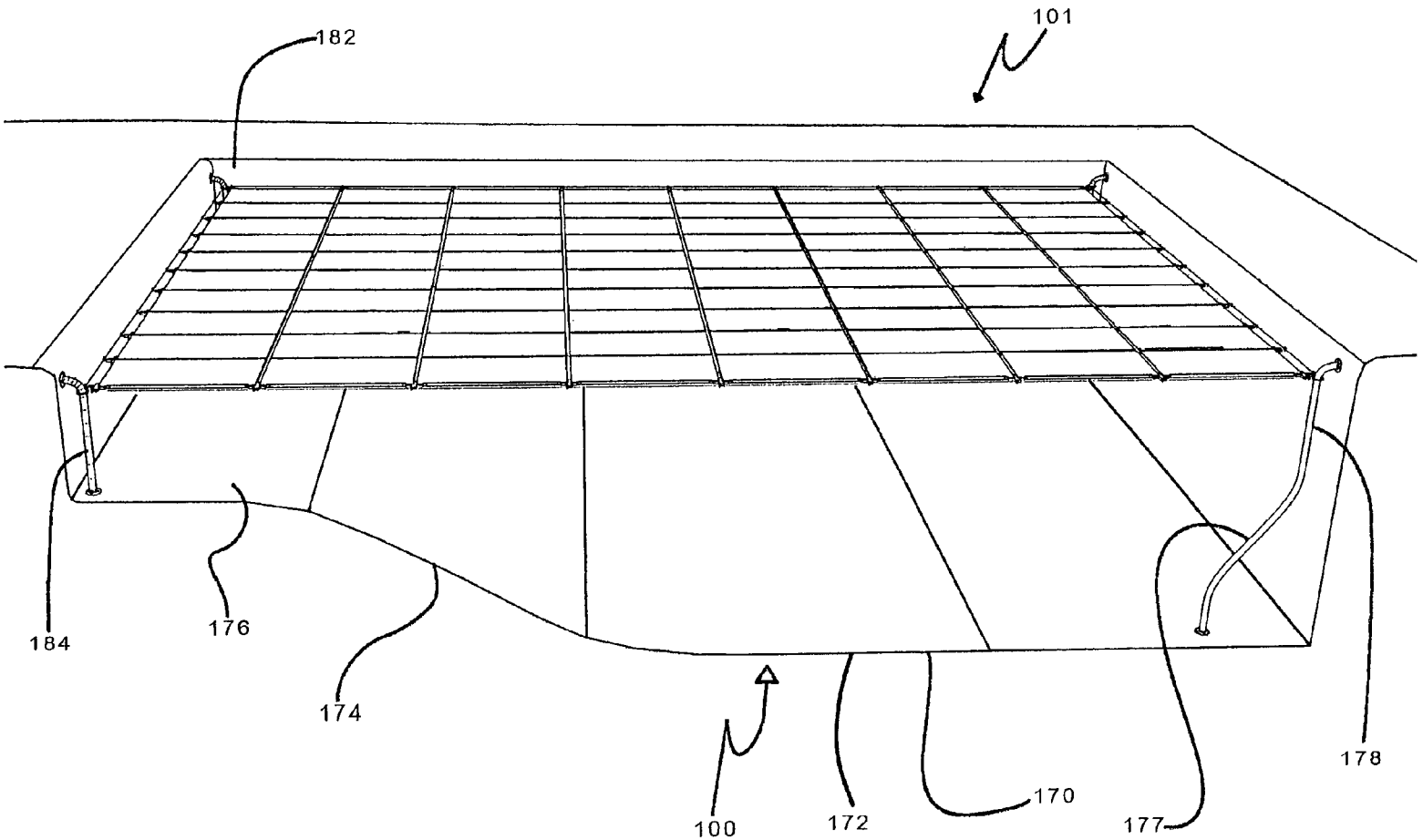
FIG. 8 is an isometric sectional view of the FIG. 1 pool and pool cover.
Figure 9:
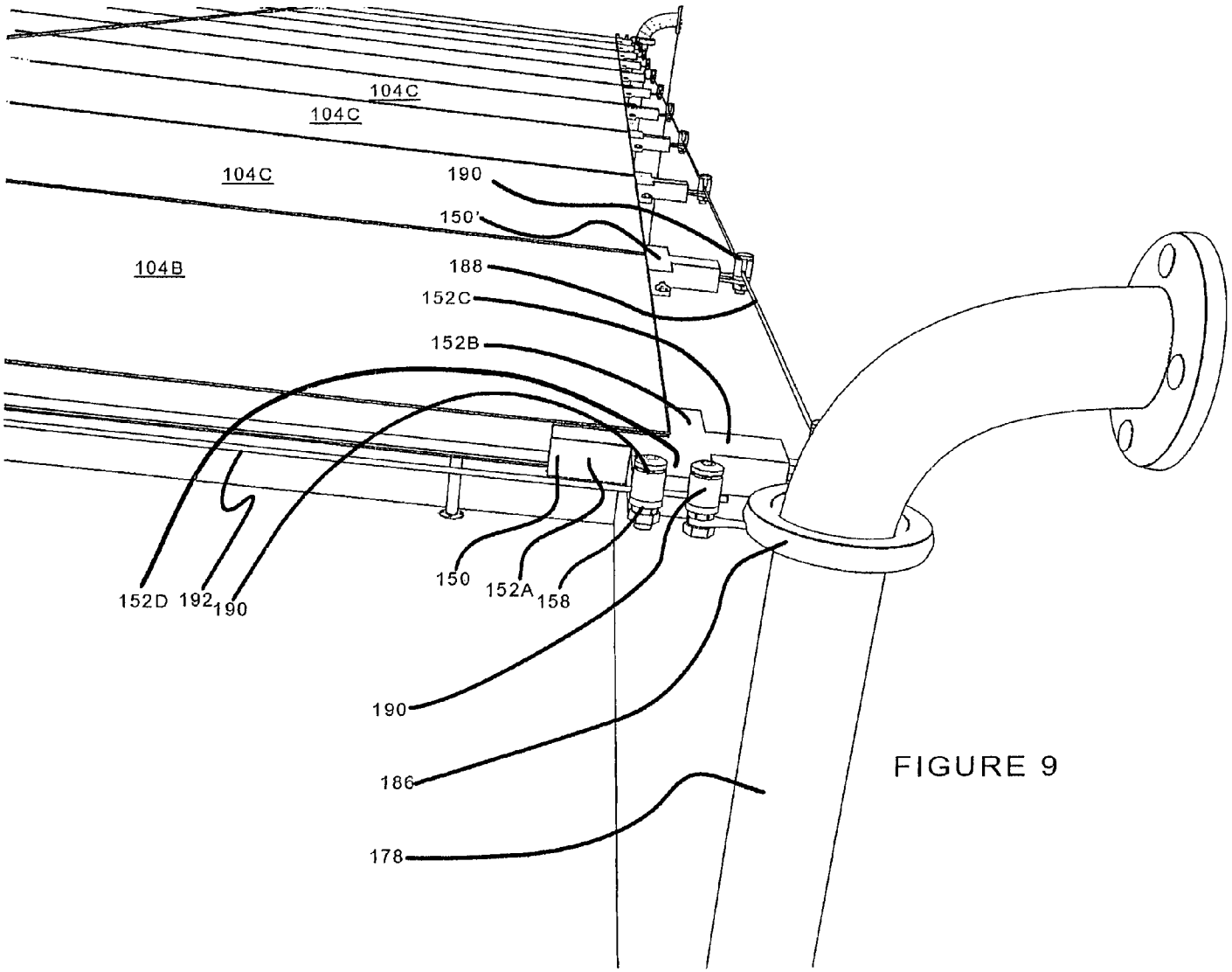
FIG. 9 is a partial isometric view of a corner of the FIG. 8 pool cover.
Figure 10:
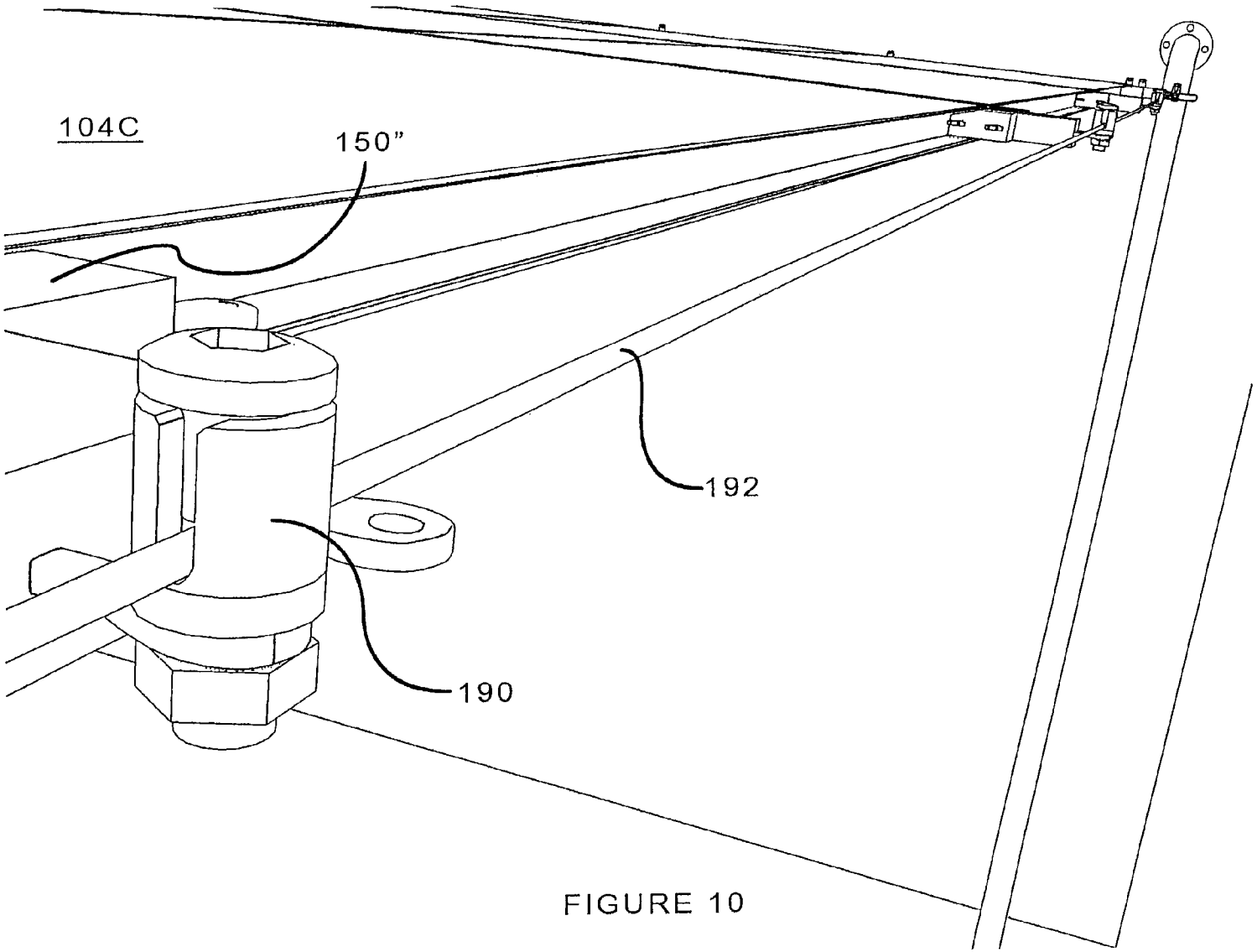
FIG. 10 is a partial isometric view of a side of the FIG. 8 pool cover.

FIGS. 8, 9 and 10 show how couplers 150 may also be used to connect corner tiles 104B and edge tiles 104C to the edges 110 of pool 100. Some detail is eliminated from FIGS. 8, 9 and 10 for clarity. In the illustrated embodiment, corner tiles 104B and edge tiles 104C are substantially similar to the inner tiles 104A, but this is not necessarily the case. Pool 100 may be provided with vertically extending shafts 178, 180, 182, 184 at spaced apart locations along its edges 110 (preferably at or near its corners). As shown best in FIG. 9, a corner tile 104B may be coupled to shaft 178 (or a similar shaft 180, 182, 184 at one of the other corners) by securing two of the branches 152A, 152B of coupler 150 to corner tile 104B in a manner similar to that described above and by securing the other two branches 152C, 152D of coupler 150 to ring member 186 which encircles shaft 178. In the illustrated embodiment, the coupling brackets 158 of coupler 150 are secured to ring member 186 using fastener components 190. Shaft 178 projects through ring member 186 in such a manner that ring member 186 may slide upwardly and downwardly on shaft 178.

In the embodiment of FIGS. 8, 9 and 10, corner tile 104B and edge tiles 104C are also connected to one another using edge cables 188, 192. As shown best in FIG. 9, two of the branches 152A, 152B of coupler 150 are coupled to corner tile 104B in a manner similar to that described above. One of the other branches 152C of coupler 150 may be secured to edge cable 188 and the last branch 152D of coupler 150 may be secured to edge cable 192. Coupler 150 may be coupled to edge cables 188, 192 by fastener components 190 which are simultaneously securable to coupling brackets 158 of coupler 150 and to one of edge cables 188, 192. Edge tiles 104C may be coupled to one of edge cables 188, 192 in similar fashion. FIG. 9 shows how edge tile 104C may be coupled to edge cable 188 using coupler 150' and one or more fastener components 190. FIG. 10 shows how edge tiles 104C may be coupled to edge cable 192 using coupler 150" and one or more fastener components 190.

Figure 11:
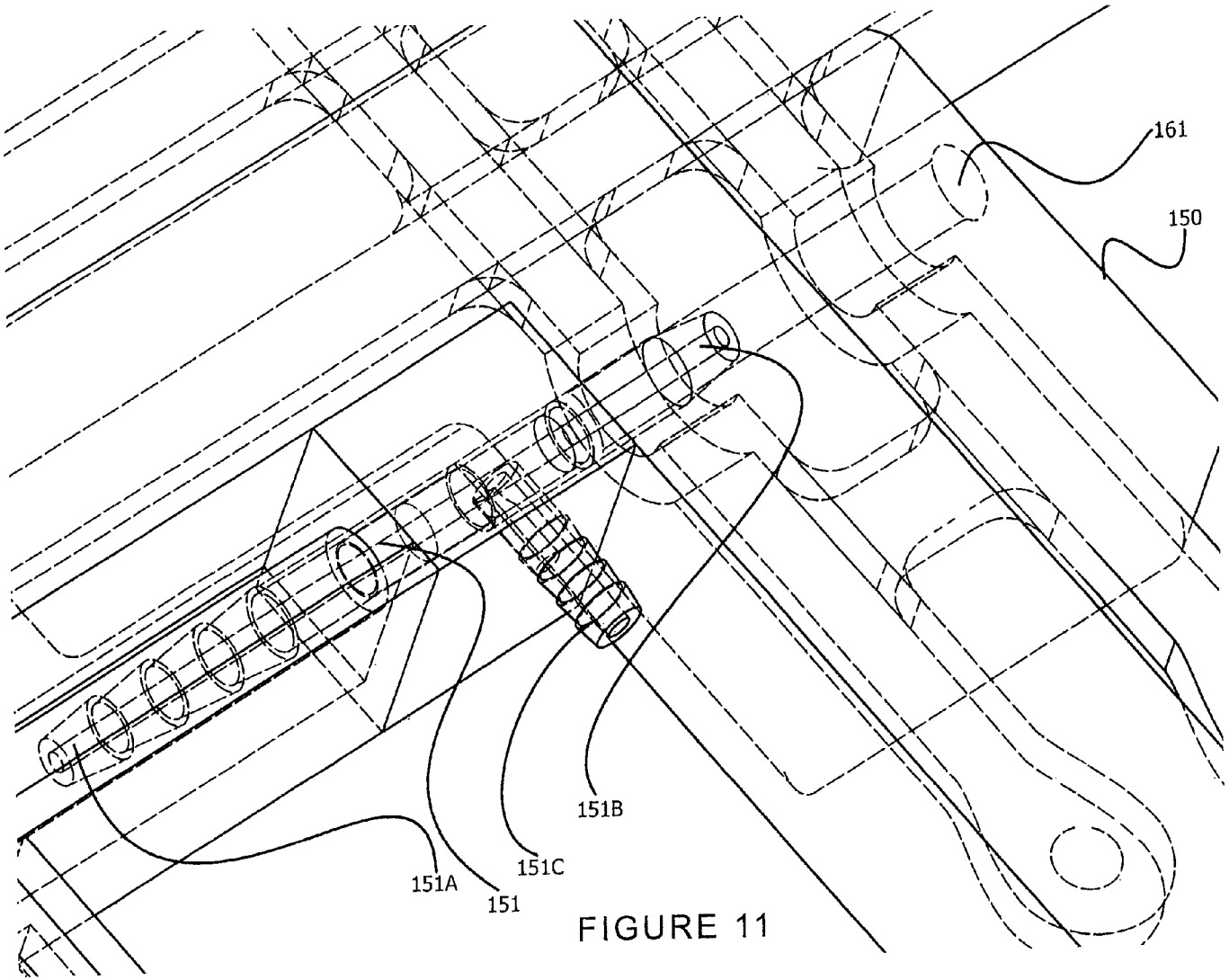
FIG. 11 is a partially see-through isometric view of a corner of the FIG. 2 tile and the FIG. 7 tile coupler.
Figure 12:
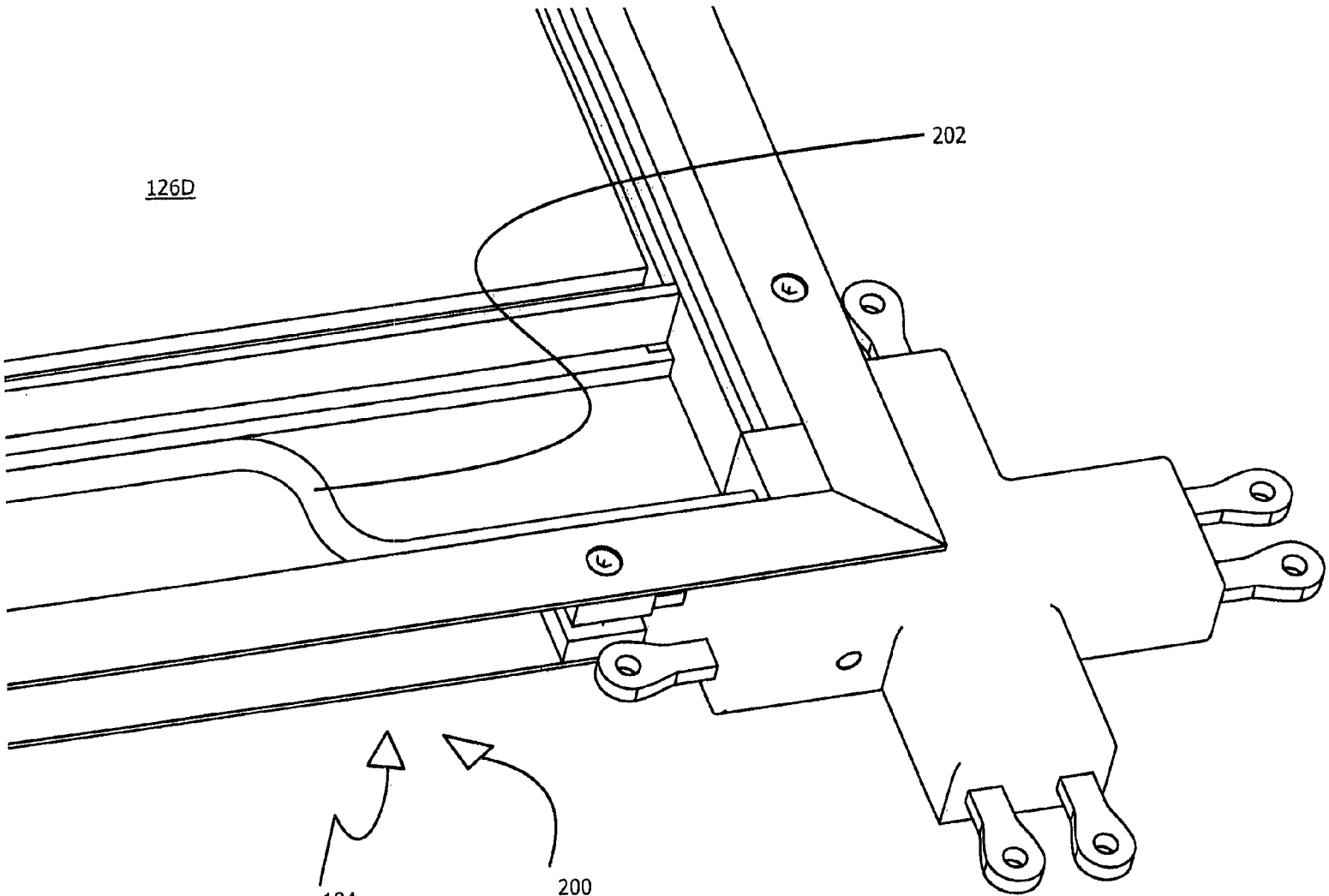
FIG. 12 is an enlarged isometric view of a portion of the FIG. 2 tile.

Tile 104 also comprise a buoyancy control system 200 for controlling its buoyancy. Buoyancy control system 200 may receive air through nipple connector 151. FIG. 11, shows nipple connector 151 in more detail. Nipple connector 151 may be provided with three connector ends 151A, 151B, 151C. As discussed above, connector end 151A may be used to connect to air conduit 148 of tile 104 and connector end 151B may be used to connect to conduit 161 of coupler 150. As shown in FIGS. 11, 12 and 13, nipple connector 151 may also comprise. a transversely extending connector end 151C which provides air flow to and from buoyancy control system 200 through air conduit 202. Air conduit 202 is connected at its other end to a nipple connector 206 of adapter member 204. Adapter member 204 and its nipple connector 206 may provide a conduit to supply air to, and withdraw air from, buoyancy control system 200. As with nipple connectors 151, 153, nipple connector 206 may be implemented using other types of valves and conduit connectors.

Figure 13A:
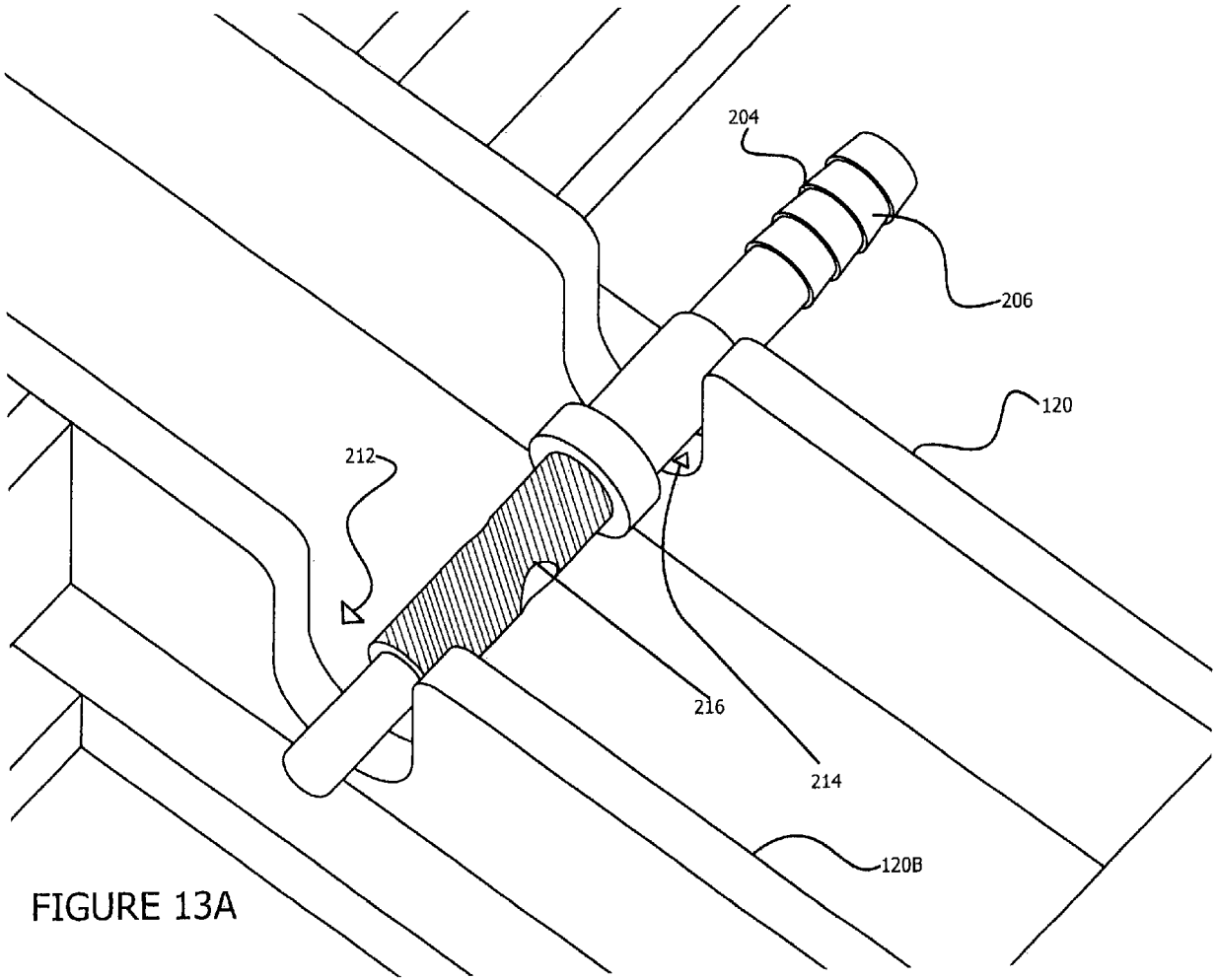
FIGS. 13A-13D are isometric views showing various components used to supply air to and to withdraw air from the buoyancy control system of the FIG. 2 tile.
Figure 13B:
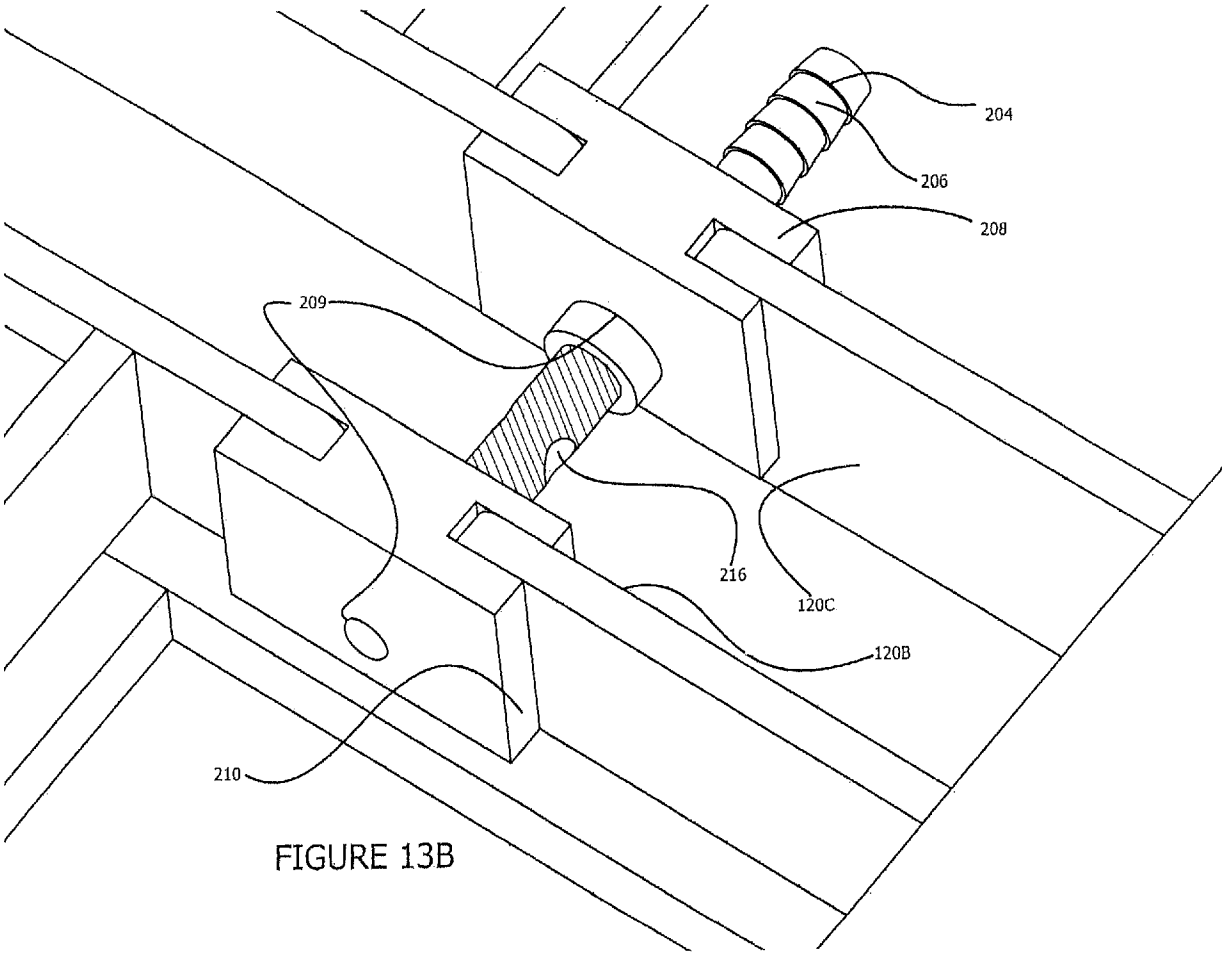
Figure 13C:
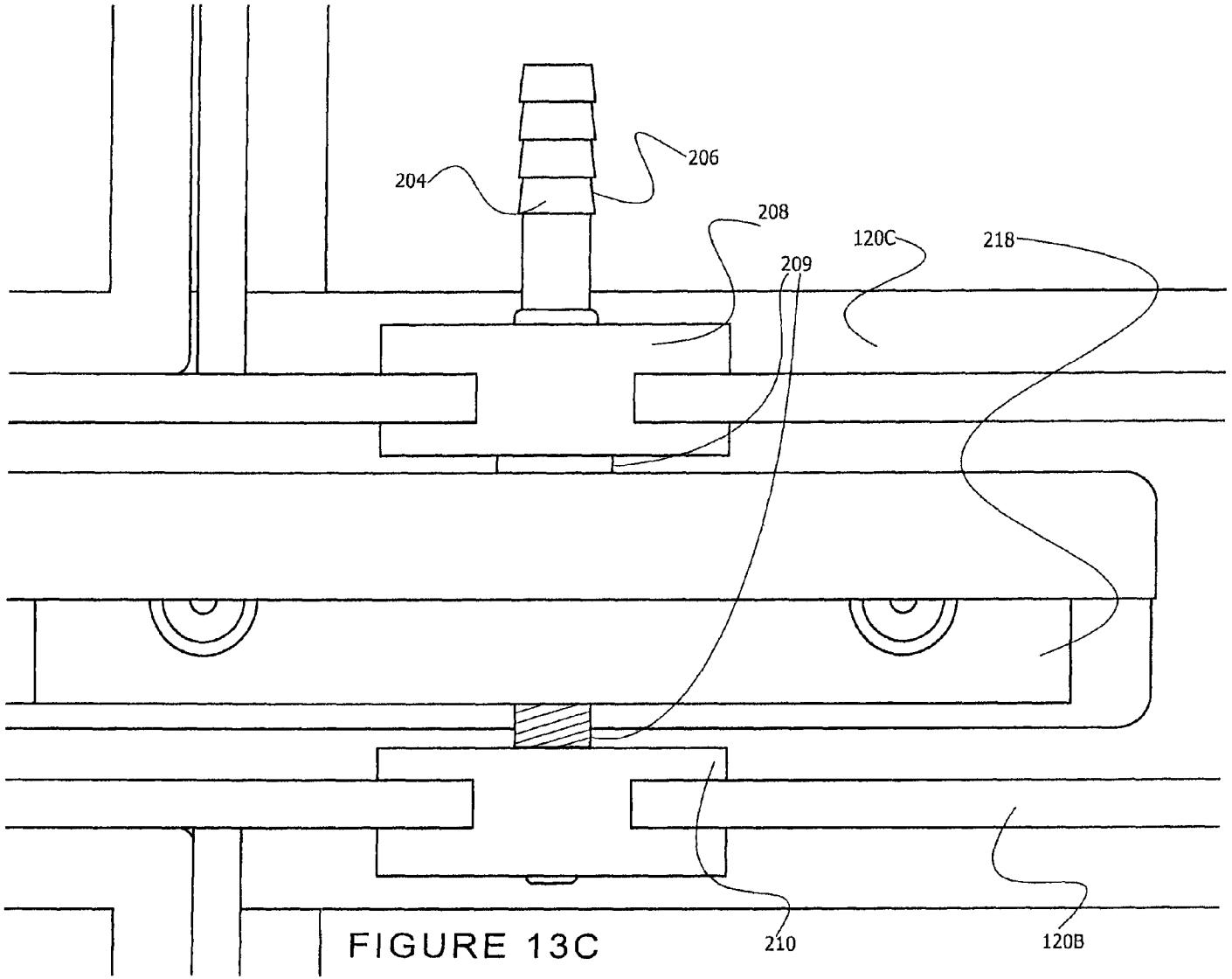
Figure 13D:
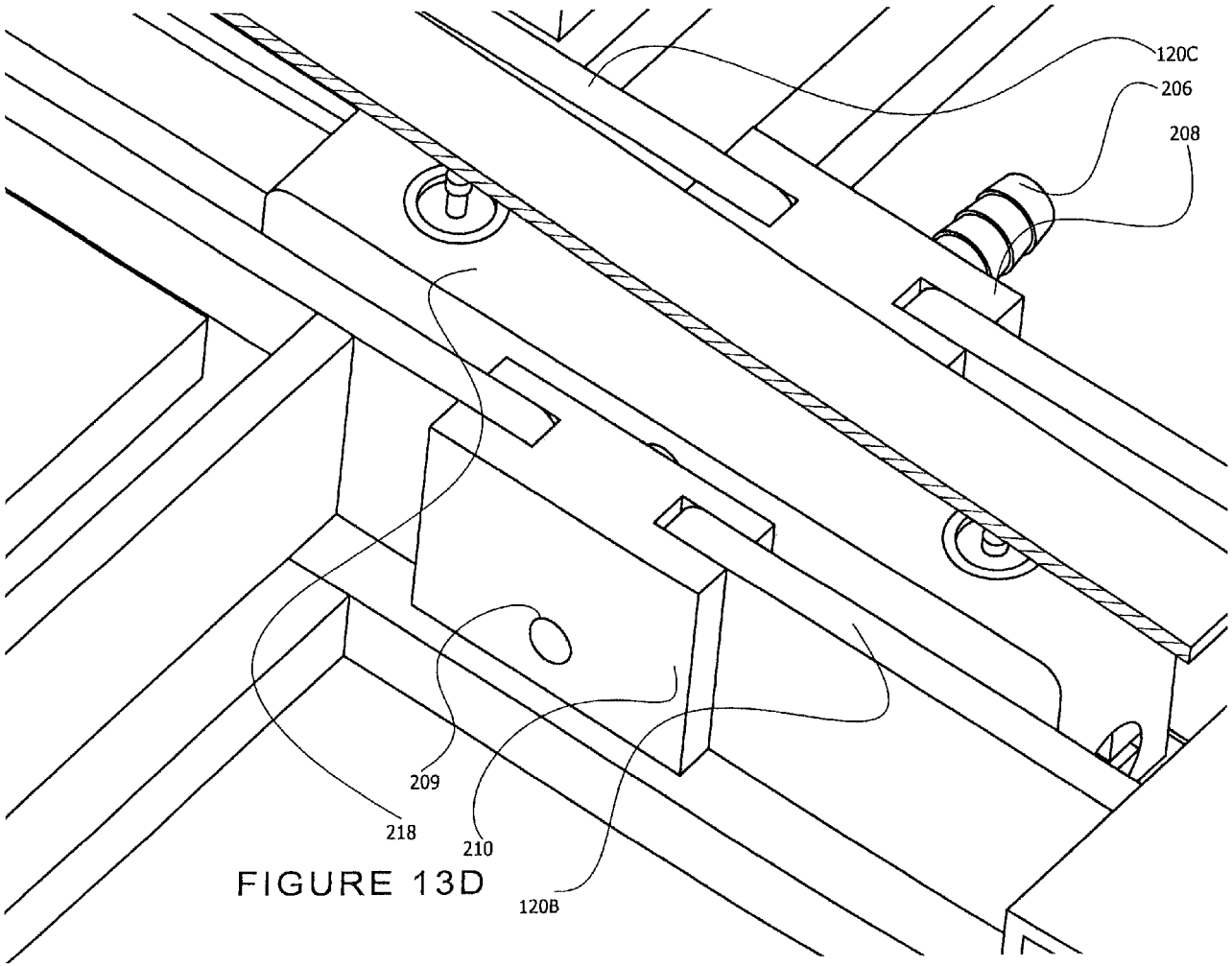

As shown best in FIGS. 13A-13D and FIG. 4, adapter member 204 may be supported between interior frame members 120C, 120B by bearing mounts 208, 210 which may respectively slidably engage slot 212 in interior frame member 120C and slot 214 in interior frame member 120B. In the illustrated embodiment, bearing mounts 208, 210 form friction fits with their corresponding interior frame members 120C, 120B. In other embodiments, suitable fasteners are used to couple bearing mounts 208, 210 to interior frame members 120C, 120B. Adapter member 204 is preferably pivotally coupled to bearing mounts 208, 210 to form a pivot joint 209 and is preferably rigidly connected to a buoyancy control valve assembly 218 (FIGS. 13C, 13D). Pivot joint 209 permits adapter member 204 and buoyancy control valve assembly 218 to pivot about a transversely extending axis relative to bearing mounts 208, 210 and frame members 120C, 120B.

Adapter member 204 comprises a port 216 (FIGS. 13A, 13B), which may be located between interior frame members 102B, 120C to supply air to, and withdraw air from, buoyancy control valve assembly 218. In the illustrated embodiment, adapter member 204 is threadably connected to buoyancy control valve assembly 218. In other embodiments, other suitable connection means may be used to operatively connect adapter member 204 to buoyancy control valve assembly 218.

Figure 14:
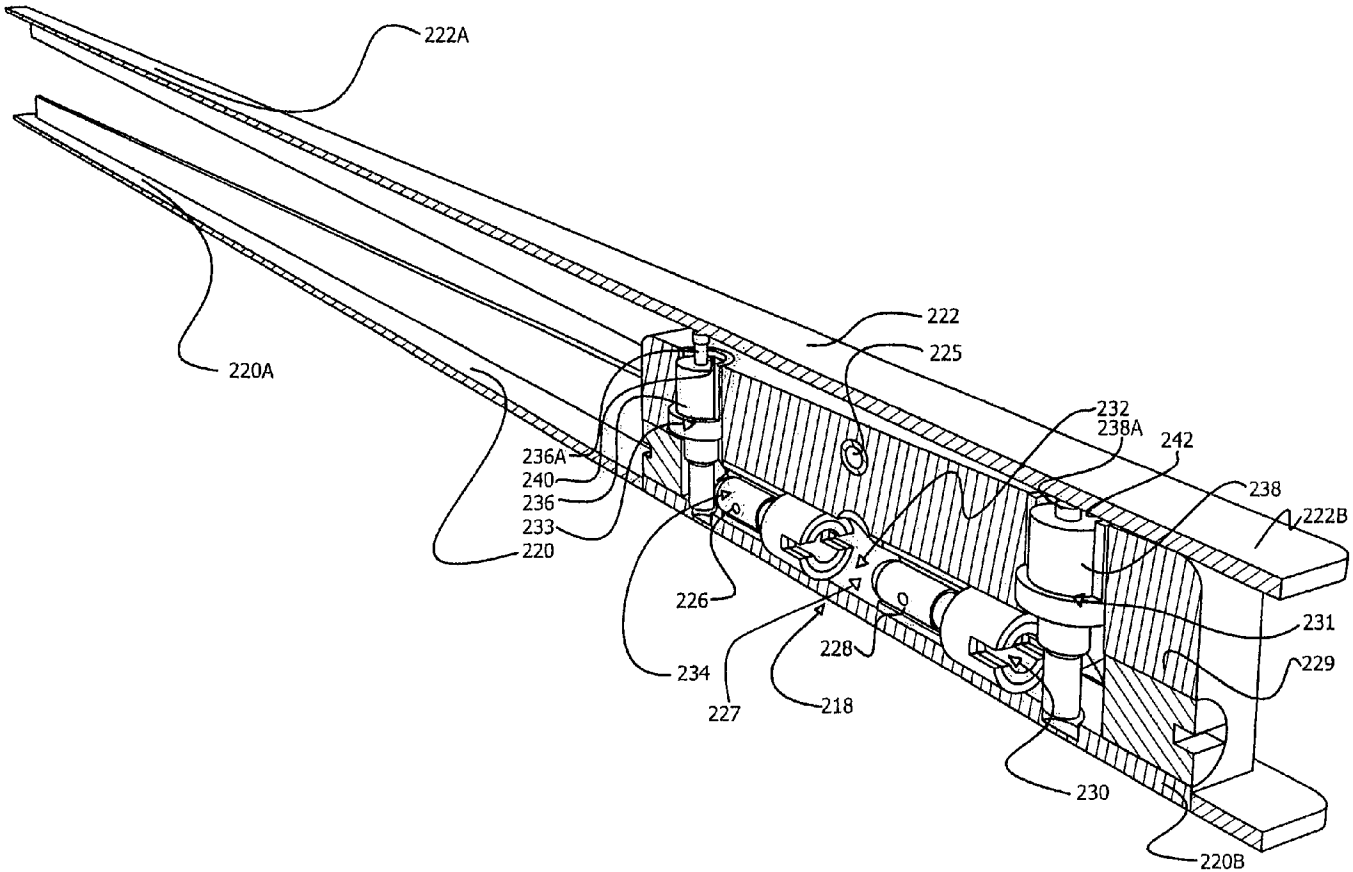
FIG. 14 is an isometric sectional view of the buoyancy control valve assembly of the FIG. 2 tile.
Figure 15:
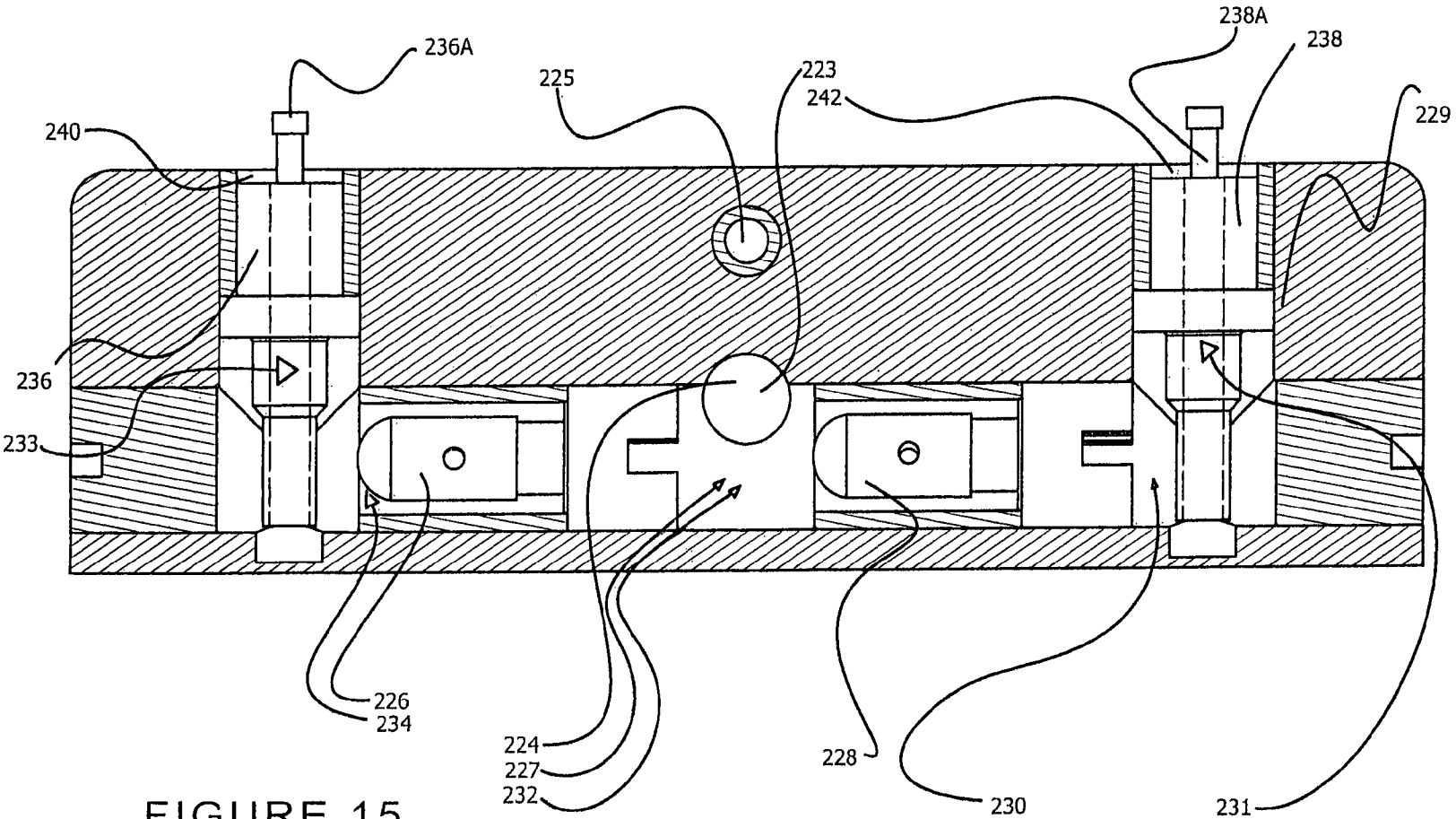
FIG. 15 is a different isometric sectional view of the buoyancy control valve assembly of the FIG. 2 tile.

FIGS. 14 and 15 show buoyancy control valve assembly 218 in more detail. In the illustrated embodiment, buoyancy control valve assembly 218 comprises a bore 223 which receives adapter member 204 such that port 216 of adapter member 204 is in fluid communication with port 224 of buoyancy control valve assembly 218. Bore 223 may be threaded (not shown) to provide threadable connection to the threaded portion of adapter member 204.

In the illustrated embodiment, buoyancy control valve assembly 218 comprises lower arm 220 and upper arm 222 which are pivotally connected to one another via pivot joint 225. Pivot joint 225 permits relative pivotal movement between upper and lower arms 220, 222 about a transversely extending axis. In preferred embodiments, arms 220, 222 extend longitudinally from pivot joint 225 in both directions to provide forward arm portions 220A, 222A and rearward arm portions 220B, 222B. Preferably, forward arm portions 220A, 222A extend forwardly from pivot joint 225 by a distance greater than ¼ of the longitudinal dimension of tile 104. In particularly preferred embodiments, the ends of forward arm portions 220A, 222A are located at the approximate center of the longitudinal dimension of tile 104. Rearward arm portions 220B, 222B may extend as far rearwardly from pivot joint 225 as external frame member 116C, but are preferably able to pivot about pivot joint 225 without contacting external frame member 116C.

Figure 16A:
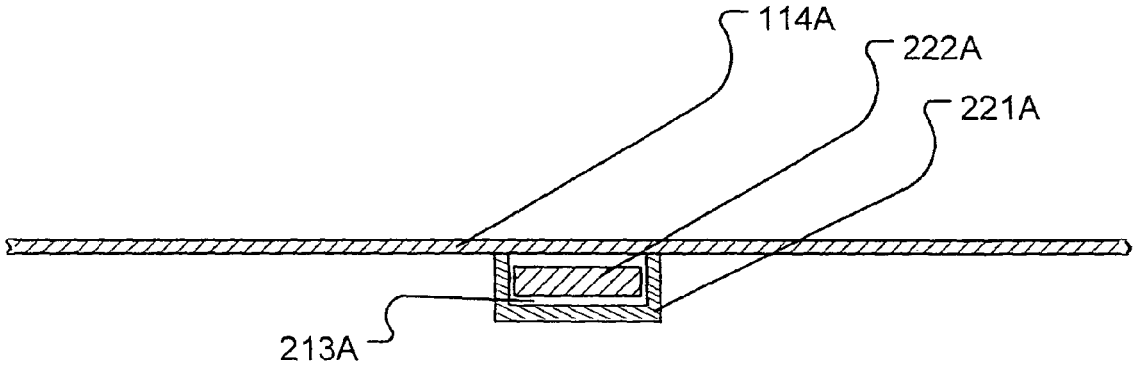
FIGS. 16A and 16B are partial plan views of the connection between the upper arm and the upper tile cover of the FIG. 2 tile.
Figure 16B:
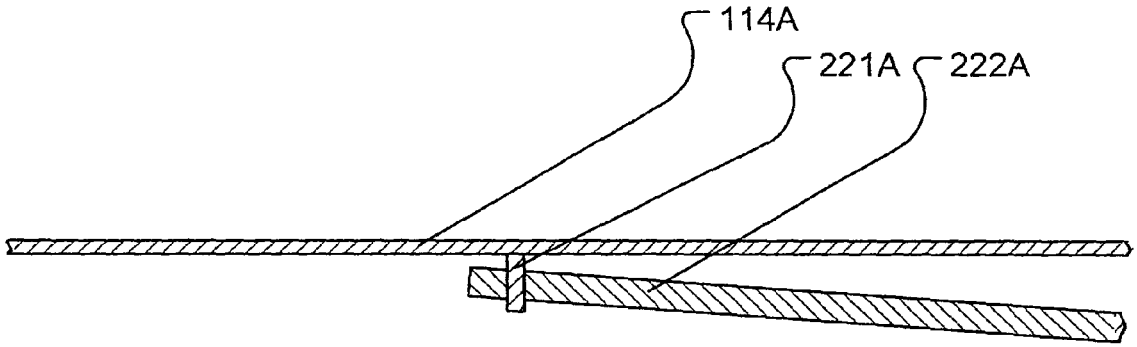

FIGS. 16A, 16B show one technique for coupling the forward portion 222A of upper arm 222 to upper cover 114A of tile 104 (i.e. for maintaining the engagement between upper arm 222 and upper cover 114A). In the illustrated embodiment, tile 104 comprises a generally U-shaped member 221A which extends downwardly from an undersurface of upper cover 114A to provide an aperture 213A. Forward portion 222A of upper arm 222 projects through aperture 213A so as to be held between the undersurface of upper cover 114A and U-shaped member 221A. A similar U-shaped member 221B (not shown) may be used to hold forward portion 220A of lower arm 220 between an upper surface of lower cover 114B and U-shaped member 221B. Those skilled in the art will appreciate that U-shaped members 221 represent only one method of coupling the arms 220, 222 to covers 114. Any suitable mechanism may be used for this purpose. In some embodiments, buoyancy control valve assembly 218 comprises a bias mechanism 217 which is coupled to pivot joint 225 in such a manner that is causes forward arm portions 220A, 222A to tend to pivot away from one another at pivot joint 225. The action of bias mechanism 217 may be counteracted by upper and lower covers 114A, 114B which will respectively assert downward pressure against forward arm portion 222A and upward pressure against forward arm portion 220A.

As shown in FIGS. 14 and 15, buoyancy control valve assembly 218 also comprises a valve body 229 which defines bores 227, 231 and 233 therein. A central region 232 of bore 227 is in fluid communication with port 224 and adapter member 204. In the illustrated embodiment, buoyancy control valve assembly 218 also comprises a pair of one-way valves 226, 228 which may be located in bore 227. Preferably, one-way valves 226, 228 are configured such that air may flow through valve 226 from central region 232 of bore 227 to region 234 of bore 227 (but not from region 234 to region 232) and such that air may flow through valve 228 from region 230 of bore 227 to region 232 of bore 227 (but not from region 232 to region 230).

Region 230 of bore 227 is in fluid communication with bore 231 and region 234 of bore 227 is in fluid communication with bore 233. Bores 231, 233 respectively comprise ports 242, 240 which are in fluid communication with the enclosure 140 formed between upper and lower covers 114 of tile 104 (see FIG. 6). Buoyancy control valve assembly 218 may also comprise piston-actuated valves 236, 238 which may control the flow of air into and/or out of ports 240, 242 and may thereby control the amount of air in enclosure 140 as described in more detail below. In the illustrated embodiment, piston-actuated valves 236, 238 are open (i.e. capable of allowing airflow therethrough) when their respective pistons 236A, 238A are depressed and piston-actuated valves 236, 238 are closed (i.e. capable of preventing airflow therethrough) when their respective pistons 236A, 238A are extended.

The operation of pool cover 101 and buoyancy control valve assembly 218 are now described with reference to FIGS. 1, 14 and 15. Referring to FIG. 1, buoyancy control system 200 of pool cover 101 comprises a pressure generator 250. Pressure generator 250 is switchable via switch 251 to introduce air to pool cover 101 (by creating a positive air pressure gradient which tends to force air into pool cover 101) or to withdraw air from pool cover 101 (by creating a negative pressure gradient which tends to withdraw air from pool cover 101). Pressure generator 250 may be implemented using one or more suitably configured pumps, compressors or the like. Pressure generator 250 is preferably located away from pool 100. In some embodiments, pressure generator 250 comprises a first pressure generator for creating a positive pressure gradient and a second pressure generator for creating a negative pressure gradient. Preferably, the pressure generated by pressure generator 250 is not overly high. In some embodiments, the pressure generated by pressure generator 250 is less than 5 atmospheres. In other embodiment, the pressure generated by pressure generator 250 is less than 2 atmospheres.

Pressure generator 250 is in fluid communication with buoyancy control system 200 of pool cover 101. In the illustrated embodiment, buoyancy control system 200 comprises a main conduit 252 and a plurality of flexible conduits 254 (one for each longitudinal column of tiles 104) which provide fluid communication between pressure generator 250 and pool cover 101. As discussed above, individual tiles 104 in each longitudinal column of tiles 104 may also be in fluid communication with each other and with pressure generator 250 via their conduits 148, nipple connectors 151, 153 and via conduits 161 of couplers 150.

When pressure generator 250 causes air to flow into pool cover 101, the air flows into enclosures 140 of individual tiles 104. As discussed above, upper and lower covers 114 are deformable and are sealed to frame flanges 130, 132 of external frame members 116. Consequently, the air introduced into enclosures 140 causes enclosures 140 to expand by respectively deforming cover 114A upwardly and deforming cover 114B downwardly. Because the air introduced into enclosures 140 is less dense than pool water, when the expansion of tiles 104 displaces a sufficient amount of pool water, individual tiles 104 will have positive buoyancy relative to the pool water. As a result, when air is introduced to tiles 104 of pool cover 101, pool cover 101 will float at or near the surface of the water in pool 100.

The operation of buoyancy control valve assembly 218 is now explained with reference to a single tile 104. Buoyancy control valve assembly 218 acts as a deformation sensing system that is sensitive to deformation of tile body 121 and/or to changes in the volume of enclosure 140. Buoyancy control valve assembly 218 may also act as a mechanical flow controller to control the amount of air introduced into enclosure 140 and withdrawn from enclosure 140. When pool cover 101 is floating atop the water in pool 100, enclosure 140 of tile is in an expanded state and upper and lower covers 114A, 114B of tile 104 are respectively deformed upwardly and downwardly. When upper cover 114A is deformed upwardly and lower cover 114B is deformed downwardly, U-shaped members 221A, 221B (or a pivot joint biasing means (if present)) act to pull forward arm portions 220A, 222A apart from one another by pivoting upper arm 222 relative to lower arm 220 at pivot joint 225 and by pivoting lower arm 220 relative to frame 118 at pivot joint 209. When forward arm portions 220A, 222A are pivoted apart from one another in this manner, valve assembly 218 may be said to be in an expanded configuration. As shown best in FIG. 14, when valve assembly 218 is in its expanded configuration, piston 236A of piston-actuated valve 236 is extended (preventing the flow of air through piston-actuated valve 236) and rearward arm portions 220B, 222B depress piston 238A (allowing air flow through valve 238).

If it is desired to cause cover 101 to sink to bottom 170 of pool 100, then switch 251 and/or pressure generator 250 (FIG. 1) are configured to cause air to be withdrawn from cover 101 (i.e. to create a negative pressure gradient between generator 250 and cover 101). Referring again to FIG. 14, this negative pressure gradient creates vacuum force at port 224 of buoyancy control valve assembly 218. Since piston 236A is extended when tile 104 is floating atop the pool water and valve assembly 218 is in its expanded configuration, no air flows through piston-actuated valve 236 or one-way valve 226. However, when valve assembly 218 is in its expanded configuration, piston 238A is depressed. Consequently, air flows from enclosure 140 through port 242, piston-actuated valve 238, region 230 of bore 227, one-way valve 228 and out of port 224.

The withdrawal of air from enclosure 140 causes the volume of tile 104 to contract (i.e. covers 114A, 114B deform toward one another). Eventually this volume reduction and accompanying deformation cause tile 104 to have a negative buoyancy relative to the pool water (i.e. a specific gravity greater than 1). Accordingly, tile 104 begins to sink toward bottom 170 of pool 100. The withdrawal of air from enclosure 140 may cause covers 114 to approach a substantially flat (i.e. undeformed) state where covers 114 approach the upper and lower surfaces of upper and lower ballast covers 144, 146. In some cases, the withdrawal of air from enclosure 140 may cause covers 114 to approach an inwardly deformed state where covers 114 abut against the upper and lower surfaces of upper and lower ballast covers 144, 146. In some embodiments, when tile 104 is in its contracted state, covers 114 are spaced less than ½" from upper and lower ballast covers 144, 146. In other embodiments, when tile 104 is in its contracted state covers 114 are spaced less than ¼" from upper and lower ballast covers 144, 146. Referring to FIG. 14, as covers 114 begin to deform toward one another, forward arm portions 220A, 222A begin to pivot toward one another by pivoting upper arm 222 relative to lower arm 220 at pivot joint 225 and by pivoting lower arm 220 relative to frame 118 at pivot joint 209.

As forward arm portions 220A, 222A continue to pivot toward one another, forward arm portion 222A pivots toward piston 236A and rearward arm portion 222B pivots away from piston 238A. Valve assembly 218 eventually reaches a configuration where piston 236A is depressed and piston 238A is no longer depressed. When the forward portions 220A, 222A are pivoted sufficiently close to one another that piston 236A is depressed and piston 238A is extended, valve assembly 218 may be said to be in a contracted configuration. When valve assembly 218 is in its contracted configuration, air is no longer capable of being withdrawn from enclosure 240 out of port 224, because: (i) piston-actuated valve 238 is no longer actuated and therefore prevents air flow through port 242; and (ii) one-way valve 226 prevents air flow from region 234 to region 232 of bore 227. In this manner, valve assembly 218 senses the deformation of tile body 121 and/or the volume of enclosure 140 and discontinues the withdrawal of air from enclosure 140 when tile body 121 has reached a lower deformation threshold and/or enclosure 140 has reached a lower volume threshold.

When valve assembly 218 is in its contracted configuration, the specific gravity of tile 104 is preferably in a range of 1.01-1.25. Consequently, tile 104 sinks until it reaches bottom 170 of pool 100 or until the negative pressure gradient created by pressure generator 250 and/or switch 251 is reversed. Those skilled in the art will appreciate that air may be similarly withdrawn from all tiles 104 of cover 101 and that all of tiles 104 of cover 101 may sink to bottom 170 of pool 100. Pressure generator 250 may be shut off after cover 101 has reached bottom 170 of pool 100. The shut off of pressure generator 250 may be performed manually or may be responsive to a pressure sensor (not shown) which may detect when cover 101 has reached a depth corresponding to bottom 170 of pool 100.

Bottom 170 of pool 100 may comprise a shallow end 176, a transition region 174 and a deep end 172 as shown in FIG. 8. As cover 101 sinks, flexible couplers 150 described above may deform so that individual tiles 104 may have different orientations than one another. For example, couplers 150 may deform such that tiles 104 in shallow end 176 and deep end 172 may be oriented generally horizontally and tiles 104 in transition region 174 may be oriented at an angle with respect to the horizontal. Shafts 178, 180, 182, 184 (together with ring members 186) may guide cover 101 toward bottom 170. In addition, one of more shafts 178, 180, 182, 184 may be provided with one or more bends 177, shaped such that cover 101 may move away from (or toward) the edges 110 of pool 100 as cover 101 sinks. The shape of bends 177 may be selected such that cover 101 conforms to the shape of bottom 170 of pool 100 when cover 101 has sunken completely.

If it is desired to cause cover 101 to rise off of pool bottom 170 toward the surface of the pool water, then switch 251 and/or pressure generator 250 (FIG. 1) are configured to cause air to be introduced into cover 101 (i.e. to supply a positive pressure gradient between pressure generator 250 and cover 101). When tile 104 is contracted and valve assembly 218 is in its contracted configuration, air is prevented from flowing from port 224 toward region 230 of bore 227 by one-way valve 228. However, piston 236A is depressed. Consequently, air flows from port 224, through one-way valve 226, region 234 of bore 227, piston-actuated valve 236, out of port 240 and into enclosure 140.

As shown in FIG. 6, the introduction of air into enclosure 140 causes the volume of enclosure 140 to expand and covers 114A, 114B to deform away from one another (i.e. cover 114A deforms upwardly and cover 114B deforms downwardly). Consequently, after a sufficient amount of expansion, tile 104 becomes positively buoyant (i.e. has a specific gravity less than 1) and begins to float toward the surface of pool 100. Referring to FIG. 14, as covers 114A, 114B begin to deform away from one another, forward arm portions 220A, 222A begin to pivot away from one another around pivot joints 225, 209.

As forward arm portions 220A, 222A continue to pivot away from one another, forward arm portion 222A pivots away from piston 236A and rearward arm portion 222B pivots toward piston 238A. Buoyancy control valve assembly 218 eventually reaches its expanded configuration where piston 238A is depressed and piston 236A is no longer depressed. When valve assembly 218 is in its expanded configuration, air is no longer capable of being introduced into enclosure 240 via port 224, because: (i) piston-actuated valve 236 is no longer actuated and therefore prevents air flow through port 240; and (ii) one-way valve 228 prevents air flow from region 232 to region 230 of bore 227. In this manner, valve assembly 218 senses the deformation of tile body 121 and/or the volume of enclosure 140 and discontinues the introduction of air into enclosure 140 when the deformation of tile body 121 reaches an upper deformation threshold and/or enclosure 140 has reached an upper volume threshold.

In some embodiments, the ratio of the upper volume threshold to the lower volume threshold is less than 1.25. In other embodiments, the ratio of the upper volume threshold to the lower volume threshold is less than 1.15.

When buoyancy control valve assembly 218 reaches its expanded configuration, the specific gravity of tile 104 is preferably in a range of 0.75-0.99. Consequently, tile 104 rises until it floats at or near the surface of the water in pool 100 or until the positive pressure gradient created by pressure generator 250 and/or switch 251 is reversed. Those skilled in the art will appreciate that air may be similarly introduced into the enclosures of all tiles 104 of cover 101 and that all of tiles 104 of cover 101 may float to the surface of the water in pool 100. Pressure generator 250 may be shut off after cover 101 has reached the surface of the water in pool 100. The shut off of pressure generator 250 may be performed manually or may be responsive to a pressure sensor (not shown) which may detect when cover 101 has reached the surface of the water in pool 100.

When cover 101 is floating atop the surface of the pool water, it may provide insulation which helps to maintain the temperature of the water in pool 100. The insulation provided by cover 101 may be superior to that of prior art designs because enclosures 140 of tiles 104 provide a relatively large volume of air between the pool water and the external environment and because that air is trapped in enclosures 140. Furthermore, ballast covers 144, 146 (which are also located in enclosures 140) may provide a relatively large amount of insulating foam. When cover 101 is floating atop the surface of the pool water, it preferably has sufficient buoyancy to support the weight of an average person to prevent drowning of a person who may fall onto cover 101. Even if the weight of a person is sufficient to cause one or more tiles 104 to sink by a small amount, the coupling of tiles 104 by couplers 150 prevents cover 101 from collapsing on itself. Together, the plurality of tiles 104 used to form cover 101 may provide sufficient positive buoyancy to support the weight of a person who falls onto cover 101.

As will be apparent to those skilled in the art in the light of the foregoing disclosure, many alterations and modifications are possible in the practice of this invention without departing from the spirit or scope thereof. For example:

The combination of upper and lower covers 114 and external frame members 116 form a generally flattened tile body 121 (FIG. 2) which covers a surface area of the pool water. Those skilled in the art will appreciate that there are other techniques (other than providing covers 114 sealed to external frame members 116) for forming the deformable enclosures 140 within tile body 121. In general, tiles 104 may comprise any type of tile body 121 or housing that contains an enclosure 140 into which air can be introduced and from which air can be withdrawn via a suitable port. Preferably, the tile body that forms the enclosures 140 is also the tile body that covers a surface area of the pool water. In addition, enclosures 140 also preferably contain ballasts 142.

In the embodiments described above, pool 100 comprises a single cover 101, wherein all of the individual tiles 104 are mechanically coupled to one another. Those skilled in the art will appreciate that a pool 100 may comprise a plurality of separate covers 101, wherein each cover 101 comprises one or more mechanically-coupled tiles 104, but wherein the covers 101 are mechanically separate from one another. This configuration permits different portions of pool 100 to be separately covered or uncovered.

In the embodiments described above, nipple connectors 151, 153, 206 are used to connect to various conduits. Those skilled in the art will appreciate that there are many other suitable connectors for providing fluid communication between conduits.

In the embodiments described above, longitudinally-adjacent tiles 104 may have air supplied to nipple connector 153 through a conduit 161 in a coupler 150. In other embodiments, air may be supplied to nipple connector 153 using other constructions, such as by a flexible hose that is separate from mechanical coupler 150, for example.

In the embodiments described above, buoyancy control system 200 is implemented such that longitudinal columns of tiles 104 are connected to pressure generator 250 in parallel and individual tiles 104 within a longitudinal column are connected in series with one another. Those skilled in the art will appreciate that there are other techniques which may be effective for connecting individual tiles 104 to pressure generator 250. By way of non-limiting example, each tile 104 may be connected to pressure generator 250 in parallel or clusters of tiles 104 having different shapes may be connected to pressure generator 250 in series or in parallel.

In the embodiments described above, coupler 150 comprises conduit 161 to provide fluid communication between a pair of longitudinally-adjacent tiles 104. In other embodiments, coupler 150 may provide fluid communication between 3 or more tiles 104 which need not be longitudinally adjacent.

In some embodiments, piston-actuated valves 236, 238 may be replaced by other suitable selectively-actuatable valves, including, without limitation, other types of mechanically actuatable valves and electronically actuatable valves. In some embodiments, piston-actuated valves 236, 238 may comprise a single selectively-actuatable valve mechanism that is configurable to a first state where it prevents fluid flow through one-way valve 226 (i.e. to discontinue air flow into enclosure 140) and to a second state where it prevents fluid flow through one-way valve 228 (i.e. to discontinue air flow out of enclosure 140).

In the embodiments described above, air is used in buoyancy control system 200 to change the specific gravity of tiles 104 and to cause tiles to float or to sink. In other embodiments, fluids other than air may be used for this purpose. In the embodiments described above, where tiles 104 contain ballasts 142 that are more dense than water, such fluids are less dense than the pool water. However, those skilled in the art will appreciate that tiles 104 may be less dense than water, in which case the fluids used in the invention may be more dense than water.

Accordingly, the scope of the invention is to be construed in accordance with the substance defined by the following claims.

What is claimed is:

1. A cover for a body of water, the cover comprising one or more tiles, each tile comprising:

a generally flattened tile body floatable atop the body of water to cover a surface area thereof, the tile body defining an enclosure wherein at least a portion of the tile body that defines the enclosure is deformable;

a ballast having a density greater than water;

a port for conveying a fluid having a density less than water into and out of the enclosure;

wherein, upon conveying the fluid into the enclosure via the port, the portion of the tile body deformably expands to increase a volume of the enclosure and increase a buoyancy of the tile and wherein, upon conveying the fluid out of the enclosure via the port, the portion of the tile body deformably contracts to decrease the volume of the enclosure and decrease the buoyancy of the tile;

a deformation sensing system for sensing deformation of the portion of the tile body, the deformation sensing system operatively coupled to: a first fluid flow limiter located between the port and the enclosure for discontinuing conveyance of the fluid into the enclosure when the deformation of the portion of the tile body is greater than an upper deformation threshold and a second fluid flow limiter located between the port and the enclosure for discontinuing conveyance of the fluid out of the enclosure when the deformation of the portion of the tile body is less than a lower deformation threshold;

wherein the deformation sensing system comprises one or more arms which engage the tile body such that deformation of the portion of the tile body causes movement of the one or more arms.

2. A cover according to claim 1 wherein the one or more arms are mechanically coupled to the first and second fluid flow limiters, such that movement of the one or more arms actuates the first and second fluid flow limiters.

3. A cover according to claim 2 wherein the one or more arms are located in the enclosure and engage one or more interior surfaces of the tile body which define the enclosure.

4. A cover according to claim 1 wherein the deformation sensing system comprises a pair of arms that pivot relative to one another about one or more pivot joints and wherein the pair of arms engage the tile body, such that deformation of the portion of the tile body changes a relative pivotal orientation of the arms.

5. A cover according to claim 4 wherein at least one of the pair of arms are mechanically coupled to the first and second fluid flow limiters, such that movement of the at least one of the pair of arms actuates the first and second fluid flow limiters.

6. A cover according to claim 1 wherein each tile comprises a buoyancy control valve assembly in fluid communication between the port and the enclosure, the buoyancy control valve assembly comprising:

first and second fluid paths between the port and the enclosure;

a first one-way valve configured to allow fluid flow from the port to the enclosure via the first fluid path and to prevent fluid flow from the enclosure to the port via the first fluid path; and a second one-way valve configured to allow fluid flow from the enclosure to the port via the second fluid path and to prevent fluid flow from the port to the enclosure via the second fluid path.

7. A cover according to claim 6 wherein the buoyancy control valve assembly comprises at least one selectively-actuatable valve mechanism configurable to a first state wherein fluid flow between the port and the enclosure via the first fluid path is prevented and to a second state wherein fluid flow between the enclosure and the port via the second path is prevented.

8. A cover according to claim 7 wherein the buoyancy control valve assembly comprises a first mechanism for configuring the at least one selectively-actuatable valve mechanism into its first state in response to the portion of the tile being deformed by an amount greater than an upper deformation threshold.

9. A cover according to claim 8 wherein the first mechanism is operable to configure the at least one selectively-actuatable valve mechanism into its second state in response to the portion of the tile being deformed by an amount less than a lower deformation threshold.

10. A cover according to claim 9 wherein the tile is in a state of positive buoyancy when the deformation of the portion of the tile is greater than the upper deformation threshold and the tile is in a state of negative buoyancy when the deformation of the portion of the tile is less than the lower deformation threshold.

11. A cover according to claim 9 wherein the first mechanism comprises one or more arms which engage the tile body such that deformation of the portion of the tile body causes movement of the one or more arms.

12. A cover according to claim 8 wherein the buoyancy control valve assembly comprises a second mechanism for configuring the at least one selectively-actuatable valve mechanism into its second state in response to the portion of the tile being deformed by an amount less than a lower deformation threshold.

13. A cover according to claim 6 wherein the buoyancy control valve assembly comprises:

a first selectively-actuatable valve configurable to allow fluid flow between the port and the enclosure via the first fluid path when the first selectively-actuatable valve is in a first flow state and to prevent fluid flow between the port and the enclosure via the first fluid path when the first selectively-actuatable valve is in a flow-prevention state; and a second selectively-actuatable valve configurable to allow fluid flow between the enclosure and the port via the second fluid path when the second selectively-actuatable valve is in a second flow state and to prevent fluid flow between the enclosure and the port via the second fluid path when the second selectively-actuatable valve is in a second flow-prevention state.

14. A cover according to claim 13 wherein the buoyancy control valve assembly comprises a first mechanism for putting the first selectively-actuatable valve in the first flow-prevention state in response to the portion of the tile being deformed by an amount greater than an upper deformation threshold.

15. A cover according to claim 14 wherein the first mechanism is operative to put the second selectively-actuatable valve in the second flow-prevention state in response to the portion of the tile being deformed by an amount less than a lower deformation threshold.

16. A cover according to claim 15 wherein the tile is in a state of positive buoyancy when the deformation of the portion of the tile is greater than the upper deformation threshold and the tile is in a state of negative buoyancy when the deformation of the portion of the tile is less than the lower deformation threshold.

17. A cover according to claim 15 wherein the first mechanism comprises one or more arms which engage the tile body such that deformation of the portion of the tile body causes movement of the one or more arms.

18. A cover according to claim 15 wherein the first mechanism comprises a pivotable arm, a portion of the pivotal arm engaging the portion of the tile body, such that deformable expansion of the portion of the tile body causes the arm to pivot in a first angular direction and deformable contraction of the portion of the tile body causes the arm to pivot in a second angular direction.

19. A cover according to claim 18 wherein the arm is mechanically coupled to the first selectively-actuatable valve and wherein pivotal movement of the arm in the first angular direction causes the first selectively-actuatable valve to enter the first flow-prevention state when the deformation of the portion of the tile body is greater than the upper deformation threshold.

20. A cover according to claim 19 wherein the arm is mechanically coupled to the second selectively-actuatable valve and wherein pivotal movement of the arm in the second angular direction causes the second selectively-actuatable valve to enter the second flow-prevention state when the deformation of the portion of the tile body is less than the lower deformation threshold.

21. A cover according to claim 14 wherein the buoyancy control valve assembly comprises a second mechanism for putting the second selectively-actuatable valve in the second flow-prevention state in response to the portion of the tile being deformed by an amount less than a lower deformation threshold.

22. A cover according to claim 13 wherein the buoyancy control valve assembly comprises a first mechanism for putting the first selectively-actuatable valve in the first flow-prevention state in response to the portion of the tile being deformed by an amount where a volume of the enclosure is greater than an upper volume threshold.

23. A cover according to claim 22 wherein the first mechanism is operative to put the second selectively-actuatable valve in the second flow-prevention state in response to the portion of the tile being deformed by an amount where a volume of the enclosure is less than a lower volume threshold.

24. A cover according to claim 1 wherein the cover comprises a plurality of tiles and at least one coupler, the coupler comprising:

four deformable branches that extend outwardly from a central region in four angularly spaced apart directions, each branch comprising one or more fastener components;

wherein, the coupler is coupleable to one of the plurality of tiles by extending corner of the tile into an angular region between first and second adjacent branches of the coupler, fastening the first branch to a first side of the tile using at least one of the fastener components of the first branch and fastening the second branch to a second side of the tile on using at least one of the fastener components of the second branch, the first and second sides of the tile on opposing sides of the corner.

25. A cover according to claim 24 wherein the coupler is coupled to four of the plurality of tiles.

26. A cover according to claim 25 wherein the coupler comprises a conduit for conducting the fluid between at least two of the four tiles.

27. A cover for a body of water, the cover comprising one or more tiles, each tile comprising:

a generally flattened tile body floatable atop the body of water to cover a surface area thereof, the tile body defining an enclosure wherein at least a portion of the tile body that defines the enclosure is deformable;

a ballast having a density greater than water;

a port for conveying a fluid having a density less than water into and out of the enclosure;

wherein, upon conveying the fluid into the enclosure via the port, the portion of the tile body deformably expands to increase a volume of the enclosure and increase a buoyancy of the tile and wherein, upon conveying the fluid out of the enclosure via the port, the portion of the tile body deformably contracts to decrease the volume of the enclosure and decrease the buoyancy of the tile;

a deformation sensing system for sensing deformation of the portion of the tile body, the deformation sensing system operatively coupled to: a first fluid flow limiter located between the port and the enclosure for discontinuing conveyance of the fluid into the enclosure when the deformation of the portion of the tile body is greater than an upper deformation threshold and a second fluid flow limiter located between the port and the enclosure for discontinuing conveyance of the fluid out of the enclosure when the deformation of the portion of the tile body is less than a lower deformation threshold;

wherein the deformation sensing system comprises a pivotable arm, a portion of the pivotal arm engaging the portion of the tile body, such that deformable expansion of the portion of the tile body causes the arm to pivot in a first angular direction and deformable contraction of the portion of the tile body causes the arm to pivot in a second angular direction.

28. A cover according to claim 27 wherein the arm is mechanically coupled to the first flow limiter and wherein pivotal movement of the arm in the first angular direction causes the first flow limiter to discontinue conveyance of the fluid into the enclosure when the deformation of the portion of the tile body is greater than the upper deformation threshold.

29. A cover according to claim 28 wherein the arm is mechanically coupled to the second flow limiter and wherein pivotal movement of the arm in the second angular direction causes the second flow limiter to discontinue conveyance of the fluid out of the enclosure when the deformation of the portion of the tile body is less than the lower deformation threshold.

30. A cover for a body of water, the cover comprising one or more tiles, each tile comprising:

a generally flattened tile body floatable atop the body of water to cover a surface area thereof, the tile body defining an enclosure wherein at least a portion of the tile body that defines the enclosure is deformable;

a ballast having a density greater than water;

a port for conveying a fluid having a density less than water into and out of the enclosure;

wherein, upon conveying the fluid into the enclosure via the port, the portion of the tile body deformably expands to increase a volume of the enclosure and increase a buoyancy of the tile and wherein, upon conveying the fluid out of the enclosure via the port, the portion of the tile body deformably contracts to decrease the volume of the enclosure and decrease the buoyancy of the tile;

a buoyancy control valve assembly in fluid communication between the port and the enclosure, the buoyancy control valve assembly comprising:

first and second fluid paths between the port and the enclosure;

a first one-way valve configured to allow fluid flow from the port to the enclosure via the first fluid path and to prevent fluid flow from the enclosure to the port via the first fluid path;

a second one-way valve configured to allow fluid flow from the enclosure to the port via the second fluid path and to prevent fluid flow from the port to the enclosure via the second fluid path;

at least one selectively-actuatable valve mechanism configurable to a first state wherein fluid flow between the port and the enclosure via the first fluid path is prevented and to a second state wherein fluid flow between the enclosure and the port via the second path is prevented; and a first mechanism for configuring the at least one selectively-actuatable valve mechanism into its first state in response to the portion of the tile being deformed by an amount greater than an upper deformation threshold and for configuring the at least one selectively-actuatable valve mechanism into its second state in response to the portion of the tile being deformed by an amount less than a lower deformation threshold;

wherein the first mechanism comprises a pair of arms that pivot relative to one another about one or more pivot joints and wherein the pair of arms engage the tile body, such that deformation of the portion of the tile body changes a relative pivotal orientation of the arms.

31. A cover for a body of water, the cover comprising one or more tiles, each tile comprising:

a generally flattened tile body floatable atop the body of water to cover a surface area thereof, the tile body defining an enclosure wherein at least a portion of the tile body that defines the enclosure is deformable;

a ballast having a density greater than water;

a port for conveying a fluid having a density less than water into and out of the enclosure;

wherein, upon conveying the fluid into the enclosure via the port, the portion of the tile body deformably expands to increase a volume of the enclosure and increase a buoyancy of the tile and wherein, upon conveying the fluid out of the enclosure via the port, the portion of the tile body deformably contracts to decrease the volume of the enclosure and decrease the buoyancy of the tile;

a buoyancy control valve assembly in fluid communication between the port and the enclosure, the buoyancy control valve assembly comprising:

first and second fluid paths between the port and the enclosure;

a first one-way valve configured to allow fluid flow from the port to the enclosure via the first fluid path and to prevent fluid flow from the enclosure to the port via the first fluid path; and a second one-way valve configured to allow fluid flow from the enclosure to the port via the second fluid path and to prevent fluid flow from the port to the enclosure via the second fluid path;

a first selectively-actuatable valve configurable to allow fluid flow between the port and the enclosure via the first fluid path when the first selectively-actuatable valve is in a first flow state and to prevent fluid flow between the port and the enclosure via the first fluid path when the first selectively-actuatable valve is in a flow-prevention state;

a second selectively-actuatable valve configurable to allow fluid flow between the enclosure and the port via the second fluid path when the second selectively-actuatable valve is in a second flow state and to prevent fluid flow between the enclosure and the port via the second fluid path when the second selectively-actuatable valve is in a second flow-prevention state; and a first mechanism for putting the first selectively-actuatable valve in the first flow-prevention state in response to the portion of the tile being deformed by an amount greater than an upper deformation threshold and for putting the second selectively-actuatable valve in the second flow-prevention state in response to the portion of the tile being deformed by an amount less than a lower deformation threshold;

wherein the first mechanism comprises a pair of arms that pivot relative to one another about one or more pivot joints and wherein the pair of arms engage the tile body, such that deformation of the portion of the tile body changes a relative pivotal orientation of the arms.

* * * * *